US006623110B2

(12) United States Patent
Koike et al.

(10) Patent No.: US 6,623,110 B2
(45) Date of Patent: Sep. 23, 2003

(54) INK JET RECORDING HEAD AND PRODUCTION METHODS THEREFOR AND PRINTER APPARATUS THEREWITH

(75) Inventors: Shuji Koike, Setagaya (JP); Yoshiaki Sakamoto, Kawasaki (JP); Tomohisa Shingai, Kawasaki (JP)

(73) Assignee: Fujitsu, Limited, Kawasaki (JP)

( * ) Notice: Subject to any disclaimer, the term of this patent is extended or adjusted under 35 U.S.C. 154(b) by 0 days.

(21) Appl. No.: 09/807,430

(22) Filed: Apr. 20, 2001

(65) Prior Publication Data

US 2001/0022602 A1 Sep. 20, 2001

Related U.S. Application Data

(63) Continuation of application No. PCT/JP99/01570, filed on Mar. 26, 1999.

(30) Foreign Application Priority Data

Oct. 20, 1998 (JP) ..... 10-297919

(51) Int. Cl.[7] ..... B41J 2/045
(52) U.S. Cl. ..... 347/68; 29/25.35
(58) Field of Search ..... 347/54, 68, 69, 347/70, 71, 72; 310/311, 330, 331; 29/25.35

(56) References Cited

U.S. PATENT DOCUMENTS 4,825,227 A * 4/1989 Fischbeck et al. ..... 347/69
5,475,279 A 12/1995 Takeuchi et al. ..... 310/331
6,145,966 A * 11/2000 Hotomi et al. ..... 347/70
6,186,618 B1 * 2/2001 Usui et al. ..... 347/70
6,347,862 B1 * 2/2002 Kanno et al. ..... 347/68

FOREIGN PATENT DOCUMENTS

EP 0726151 * 8/1996 ..... B41J/2/14
EP 0 572 230 B1 10/1996
EP 0 786 345 A2 7/1997
JP 63-128948 6/1988
JP 6-40035 2/1994

OTHER PUBLICATIONS

Office Action, German Patent Office, dated Jun. 10, 2002, and translation.

* cited by examiner

*Primary Examiner*—Anh T.N. Vo
(74) *Attorney, Agent, or Firm*—Armstrong, Westerman & Hattori, LLP

(57) ABSTRACT

The present invention relates to an ink jet recording head and a production method therefor, wherein ink is spouted by vibrating a vibrating plate that is a wall part of a pressure chamber, using an ink jet energy generating part. In the ink jet recording head that comprises a main body formed by a plurality of pressure chambers provided corresponding to nozzles that spout ink, the vibrating plate that constitutes a wall of the compression chamber being provided to the main body and an energy generating part provided on the vibrating plate at a position corresponding to a forming position of the pressure chamber, which makes the ink inside the pressure chambers spouted from the nozzles by deformative-energizing the vibrating plate, the vibrating plate and the ink jet energy generating part are formed using the thin film forming technology.

52 Claims, 21 Drawing Sheets

INK JET RECORDING HEAD AND PRODUCTION METHODS THEREFOR AND PRINTER APPARATUS THEREWITH

This application is a continuation of international application PCT/JP99/01570 filed on Mar. 26, 1999.

FIELD OF THE INVENTION

The present invention generally relates to an ink jet recording head, production methods therefor, and a printer apparatus, and particularly relates to the ink jet recording head which jets ink using jet energy generation part to vibrate a vibrator provided as a wall of a pressure chamber, production methods therefor, and a printer apparatus therewith.

Recently, a printer apparatus has been widely used as an output device for a personal computer. The printer apparatus is generally based on a wire driving method or an ink jet method.

An ink jet recording head used in an ink jet type printer apparatus generates less noise than a head that prints by magnetically driving wires to pressurize a platen through an ink ribbon and a sheet of paper, drawing attention as appropriate for office use.

DESCRIPTION OF THE BACKGROUND ART

A conventional ink jet recording head comprises nozzles, ink chambers, ink supply systems, ink tanks and transducers, recording letters and images onto such a recording media as paper by jetting ink particles from the nozzles by transferring displacements or pressures originated at the transducers to the ink chambers.

A widely known method is to use a thin plate of a piezoelectric device that has one surface thereof completely bonded to an external wall of the ink chamber as the transducer. A voltage pulse is applied to the piezoelectric device to bend the compound plate of the piezoelectric device and the external wall of the ink chamber. The displacement/pressure caused by the bend is transferred into the ink chamber through the external wall of the ink chamber.

FIG. 1 is a side view of a printer apparatus (an ink jet recording apparatus) provided with an ink jet recording head 2. In the drawing, a recording media 1 is subjected to printing or the like by the printer apparatus. An ink jet recording head 2 jets ink to the recording media 1. An ink tank 3 provides the ink to the ink jet recording head 2. On a carriage 4, the ink jet recording head 2 and the ink tank 3 are mounted.

A transporting roller 5 and a pinch roller 6 transport the recording media 1 to the ink jet recording head 2 by holding it in between. An ejecting roller 7 and a pinch roller 8 transport the recording media 1 to an ejecting direction by holding it in between. A stacker 9 stores the ejected recording media 1. A platen 10 holds the recording media 1.

The ink jet recording head 2 is so structured as to jet the ink by a pressure generated by expansion and contraction of a piezoelectric device that is driven by a voltage, thereby printing letters or the like on the recording media 1.

FIG. 2 is an oblique angle view of the ink jet recording head 2. As the drawing shows, the ink jet recording head 2 comprises a plurality of piezoelectric devices 11, individual electrodes 12 formed on the piezoelectric devices 11, a nozzle plate 13 that is provided with nozzles 17, a vibrating plate 15, ink chambers (pressure chambers) 14 that are formed corresponding to each of the nozzles 17, and a main body 16 made of a metal or resin.

The nozzle 13 and the vibration plate 15 are designed to face with the ink chamber 14. A portion around the ink chamber 14 of the main body 16 is firmly fixed to the vibrating plate 15. The vibrating plate 15 is so structured as to bend when a voltage is applied to drive the piezoelectric device 11, as shown by the dotted lines in the drawing. Further, the structure allows a voltage to be applied to each of the piezoelectric devices 11 based on electrical signals coming from a printer apparatus main body (not shown in the drawing).

In the conventional ink jet recording head 2, the piezoelectric devices 11 are formed by either pasting plate-like piezoelectric devices 11 on the vibrating plate 15 at a position corresponding to an ink chamber or forming a piezoelectric material on the whole upper surface of the vibrating plate 15 and removing the material except for locations corresponding to the ink chambers to be formed.

In the example shown in FIG. 2, the piezoelectric devices 11 are used as a means to displace the vibrating plate 15. An ink jet recording head that employs thermal elements in place of the piezoelectric devices 11 has been available. The ink jet recording head that employs the thermal elements is structured such that it is provided with thermal elements at the position of the vibrating plate 15 described above, which are made of layers of materials of different thermal expansion coefficients. The thermal expansion generated by heating the elements causes a displacement of the vibration plate 15, and thereby ink is jetted out. In the following, an item that generates energy to displace the vibrating plate 15, which includes the piezoelectric elements 11 and thermal elements described above will be called an ink jet energy generating part.

In recent years, there has been a demand for reducing the power consumption of personal computers. Accordingly, reduced power consumption (semiconductor driving voltage of around 20V) is required of printing devices serving as peripheral equipment. Furthermore, higher resolution is required of the printing devices, so that flight particles of the ink jet recording head are made finer and finer.

Specifically, following requirements need to be satisfied to achieve what is required above. That is, in the case of using a piezoelectric element for the ink jet energy generating part:

a) thin-filming of the piezoelectric element (same internal applied electric field);
b) thin-filming of the vibration plate (transferring a minute displacement of the piezoelectric element);
c) stable adherence of the piezoelectric element to the vibrating plate (reducing loss of piezoelectric element displacement);
d) higher flatness of the vibrating plate (ease of bending the vibrating plate); and
e) a minute process of the piezoelectric device and the vibrating plate are required.

In the case of using the thermal element in the ink jet energy generating part, f) finer wiring of wires connected to the thermal element;
g) shorter heat dissipation time; and
h) thinner protection films of the thermal devices are required.

In the conventional ink jet recording head 2 described with reference to FIG. 2, following problems are present. Namely, in the structure where the piezoelectric device is bonded to the vibrating plate, 1) a thin piezoelectric element is susceptible to damages when the piezoelectric device is bonded to the vibrating plate;
2) in the structure where the piezoelectric device is bonded to the vibrating plate, thickness of an adhesive material layer is non-uniform, causing difficulties to obtain a flat vibrating plate, and thereby cases happen wherein it does not displace properly when driven;
3) an adhesive material absorbs displacement of the piezoelectric element when a voltage is applied to the piezoelectric element; and
4) miniaturization is difficult with the structure where the piezoelectric element is bonded to the vibrating plate.

Further, in a structure in which a piezoelectric material provided all over the vibrating plate is divided by a machine process, the problems 1) through 4) described above are encountered in the same manner. Furthermore, the machine process presents problems that it takes a longer processing time and provides a less production efficiency.

When the thermal element is used in the ink jet energy generating part, the board that carries the thermal element thereon may not have proper heat releasing characteristics.

DISCLOSURE OF THE INVENTION

The present invention is made in view of the points described above with an object to provide an ink jet recording head and production methods therefor and a printer apparatus which hold a high reliability while enabling to reduce consumption power.

To achieve the object, the present invention takes a structure wherein at least an ink energy generating part employs the thin film forming technology in an ink jet recording head that comprises a main part that is formed by a plurality of pressure chambers which are provided corresponding to nozzles that spout the ink and in which ink is filled, a vibrating plate that is formed by a vibratable material and is a part of a wall of the pressure chambers described above, and an ink jet energy generating part that is provided on the vibrating plate described above corresponding to the pressure chambers described above and that causes the nozzles described above to spout ink from the pressure chambers described above by deformatively energizing the vibrating plate described above.

Such an inkjet record head makes it possible to form a thin and fine inkjet energy generating part with high precision and reliability by employing a thin-film production technology in making the inkjet energy generating part. This achieves the reduction of power consumption and the printing of higher resolution.

Further, to achieve the present invention, in the ink jet recording head production method, an energy generating part forming step wherein the ink jet energy generating parts are formed by forming an individual electrode layer, an energy generating layer and a vibration layer sequentially on a base plate using the thin film forming technology, a removal step wherein the ink jet energy generating parts described above are exposed from the base plate described above by forming an opening part by removing an part that corresponds to a deforming portion of at least a the ink jet energy generating part described above, and a bonding step wherein a main component pre-formed with pressure chambers for jetting ink and the described vibrating plate part bonded, and a nozzle installation step wherein nozzle holes that spout ink are formed at positions corresponding to the described pressure chambers and at the same time a nozzle plate is provided on the described main component are performed.

By the ink jet recording head production method described above, a thin ink jet energy generating part can be formed with a high accuracy and a high reliability, because the individual electrode layer, the energy generating layer and the vibrating layer are formed sequentially on the base plate using the thin film forming technology.

Further, because there is no bonding materials such as an adhesive material between the layers, it is possible to form the ink jet energy generating part with high flatness, and thereby there is no absorption of a displacement of a piezoelectric element by the adhesive material, as was the case conventionally. Therefore, an ink jet recording head with a potentiality of a reduced power consumption and a high resolution can be realized.

Further, in the removal step, the ink jet energy generating parts are exposed from the base plate by forming an opening part by removing a predetermined part of the base plate, a part other than the exposed part keeps protected by the base plate. Therefore, the protection is dependably performed when the ink jet energy generating part is made thin.

Subsequently, by performing the bonding step and the nozzle plate installation step, the ink jet energy generating part described above is bonded to the main body which is formed with pressure chambers. In this manner, a flat vibrating plate can be provided to the pressure chambers, enabling production of an ink jet recording head whose piezoelectric elements are closely bonded to the vibrating plate and which can be driven efficiently and without unevenness.

The present invention, in the ink jet recording head production method described above, may structure the described bonding step by comprising a first bonding step wherein a first half of the main component pre-formed by a first half of the pressure chambers on the vibrating layer mentioned above for ink jetting, which is performed between the described energy generating part forming step and the described removal step and a second bonding step wherein a second half of the main body component pre-formed by a second half of the pressure chambers for ink jetting is bonded to the described first half of the main component after the described removal step is finished.

By the ink jet recording head production method above described, between the energy generating part forming step and the removal step, that is, before the removal step is performed, the first bonding step is performed. By bonding the first half of the main body formed with the first half of the pressure chambers onto the vibrating layer, the base plate is structured as reinforced by the first half of the main body component.

Accordingly, when an opening part is formed during the removal step, there is the first half of the main component on the rear side of the opening part forming location, thereby preventing a damage of the ink jet energy generating part when the opening part is formed. Further, by forming the opening part, mechanical strength of the ink jet energy generating part that is exposed from the opening part is weakened, however, thanks to the presence of the first half of the main component that functions as a reinforcement material on the rear side of the opening part forming position, whereby preventing a damage of the ink jet energy generating part after the opening part is formed.

Further, the main body is formed by performing the second bonding step after the removal step, thereby bonding the second half of the main component formed by the second half of the pressure chambers, and through a cooperation between the first and the second halves of the pressure chambers.

Further the present invention can be structured in the ink jet recording head production method described above such that the described energy generating part forming step may take a dividing step wherein the individual electrodes are formed by dividing the described individual electrode layer at the forming position of the described ink jet energy generating part, after the described individual electrode layer is formed and before the described energy generating layer is formed.

According to the ink jet recording head production method described above, the individual electrodes can be formed easier than the method wherein the individual electrode layer is divided via the opening part, because the individual electrodes are formed before the opening part is formed by performing the dividing step after the individual electrode layer is formed and before the energy generating layer is formed to form the individual electrodes by dividing the individual electrode layer at the forming position of the ink jet energy generating part.

Further, the present invention, in the ink jet recording head production method, can provide a dividing step wherein the individual electrodes are formed by the energy generating part forming step described above through dividing both the individual electrode layer described above, which is exposed to the opening part described above, and the energy generating layer at the forming position of the ink jet energy generating part described above after the removal step described above is finished.

According to the ink jet recording head production method described above, by performing the dividing step after the removal step is finished, and by forming the individual electrodes by dividing both of the individual electrode layer exposed at the opening part and the energy generating layer at forming position of the ink jet energy generating parts, the adjacent ink jet energy generating parts become a perfectly independent structure. Accordingly a deforming capability (drivability) of the ink jet energy generating parts when a voltage is applied is enhanced, thereby a mechanical mutual interaction among the adjacent ink jet energy generating parts is low, enabling a highly responsive ink jetting.

Further, the present invention can be structured in the ink jet recording head production method such that it has a dividing step wherein the individual electrodes are formed by dividing only the individual electrode layer exposed to the opening part described above at the ink jet energy generating part forming position after the removal step described above is finished.

By the ink jet recording head production method described above, the ink jet energy generating part with a small amount of an internal distortion can be structured, because the individual electrodes are formed by dividing only the individual electrode layer exposed to the opening part at the described ink jet energy generating part forming position.

That is, in a dividing step wherein the individual electrodes are formed by dividing before the energy generating layer is provided, when the energy generating layer is formed, there emerge a portion where the energy generating layer is deposited directly on the base plate and another portion where the energy generating layer is deposited on the individual electrodes. Due to this, the energy generating layer is susceptible to an internal distortion caused by crystal growth unevenness, difference in lattice constants or the like from damages to the base board at the individual electrode removal. If the opening part is formed on the base board under this situation, damages (cracks and deformation) can happen at the boundaries of the individual electrodes due to the internal distortion at the thin film part after the removal.

Whereas, by forming the individual electrode layer on the whole surface of the base board as well as the energy generating layer is formed thereupon, and then performing the dividing step of dividing the individual electrode layer via the opening part after the removal step is finished, the ink jet energy generating part with a small amount of the internal distortion can be formed, thereby enabling to enhance a reliability of the ink jet recording head to be manufactured.

Further, the present invention, in the ink jet recording head production method described above, the ink jet energy generating part described above can be formed over a plurality of pressure chambers described above in the energy generating part forming step described above.

According to the ink jet recording head production method described above, strength of the ink jet energy generating part can be enhanced by forming the ink jet energy generating part over a plurality of the pressure chambers in the energy generating part forming step.

That is, if the ink jet energy generating part is formed in the forming part of the pressure chambers, the structure is such that the ink jet energy generating part is supported only by a thin vibrating plate, reducing the strength, because the pressure chambers are vacant parts. Whereas, by forming the ink jet energy generating part over a plurality of pressure chambers, the ink jet energy generating part is supported by the peripheral part of the base plate, thereby enhancing the strength of the ink jet energy generating part.

Further, to achieve the object described above, the ink jet recording head production method of the present invention performs an energy generating part forming step wherein the ink jet energy generating parts are formed by forming an energy generating layer that makes the ink jet energy generating part and a vibration layer sequentially on the base plate using the thin film forming technology, a removal step wherein the described ink jet energy generating parts are exposed from the described base plate by forming an opening part by removing an part that corresponds to a deforming portion of at least the described ink jet energy generating part, an individual electrode forming step wherein the individual electrodes are formed at positions corresponding to the described ink jet energy generating part via the described opening part after the removal step is finished, and an bonding step wherein a main component that is formed in advance with pressure chambers for jetting ink is bonded to the described vibration plate.

According to the ink jet recording head production method described above, the energy generating layer can be grown in a monocrystal condition according to the lattice constant of the base plate (the lattice constant is not uniform, but has an internal distortion), by forming the energy generating layer that will become the ink jet energy generating part and the vibrating layer sequentially on the base plate using the thin film forming technology.

Now, if there is a metal electrode layer (individual electrode layer) without a crystal lattice is present between the base plate and the energy generating layer, when the energy generating layer is formed, there is a case where its lattice may be deformed, disabling to obtain a good jetting energy.

Whereas, by forming the individual electrodes by performing the individual electrode forming step on the surface of the energy generating layer that is exposed from the opening part after the opening part is formed on the base board in the removal step, it is possible to form the ink jet energy generating part that has a required lattice constant, enabling to obtain a good jetting energy. Therefore, highly reliable printing process is enabled.

Further, the present invention, in the ink jet recording head production method described above, the dividing position where the dividing process described above is performed in the dividing step described above may be set at a position between pressure chambers described above that are next to each other.

According to the ink jet recording head production method described above, protection of the vibrating plate can be secured by setting the dividing position of the dividing process for the individual electrode layer in the dividing step at a position between adjacent pressure chambers.

That is, because the pressure chamber is a vacant part, the structure of the ink jet energy generating part (including the individual electrode layer) is such that it is supported only by the thin vibrating plate. Therefore, there is a possibility of a crack and other damage developing to the vibrating plate if the individual electrode layer dividing step takes place in the forming part of the pressure chambers.

Whereas, by setting the dividing position of the individual electrodes at a position between the adjacent pressure chambers, the dividing position is not the pressure chambers but on the base board, thereby the structure is such that the ink jet energy generating part is formed over the pressure chambers, enabling a secure protection of the vibrating plate.

Further, to achieve the object described above, the ink jet recording head production method of the present invention performs: the individual electrode forming step where in the individual electrode layer is formed on the base plate using the thin film forming technology; the individual energy generating layer forming step wherein individual energy generation layer is formed at least on the individual electrode layer described above; a filling step wherein a filler material is provided to a gap between the individual energy generation layers described above which are formed in the individual energy generating layer forming step described above; the energy generating part forming step where in the ink jet energy generating part is formed by performing a vibrating layer forming step wherein a vibrating layer is formed above the individual energy generating layer described above and the filler material described above; the removal step wherein the ink jet energy generating part described above is exposed from the base plate described above by forming an opening part by removing at least an part corresponding to the deforming portion of the ink jet energy generating part described above of the base plate described above; and the bonding step wherein the main body component that is formed in advance with pressure chambers for ink jetting is bonded to the vibrating plate described above.

According to the ink jet recording head production method described above, by providing the filler material to the gap between the ink jet energy generation parts, a structure that is flat and free from bending is obtained, thereby enabling a smooth ink jetting.

That is, if the vibrating plate is formed on the ink jet energy generating part that has unevenness without the filler material, a bent of the vibrating plate occurs at a bump of the unevenness, which binds deformation of the ink jet energy generating part, causing a possibility to create a hindrance in ink jetting.

Whereas, by providing the filler material to the gap between the ink jet energy generating parts at the filling step, its surface is flattened and forming the vibrating plate on the flat surface, a structure that is flat and free from a bent is obtained. In this manner, by making the structure free from the bent, a smooth ink jetting is enabled.

Further, the present invention may use the same material as the base plate described above as the filler material described above in the ink jet recording head production method described above.

According to the ink jet recording head production method described above, by using the same material as the base plate as the filler material, when the opening part is formed in the removal step to be performed later, the filling material in the gap of the ink jet energy generating part is removed simultaneously. For this reason, each ink jet energy generating part has an independent structure, thereby drivability of the ink jet energy generating part can be enhanced.

Further, the present invention may use a material whose Young's modulus is smaller than the energy generating layer described above and less than 90 GPa as the filler material in the ink jet recording head production method described above.

According to the ink jet recording head production method described above, by using a material with a low Young's modulus as the filler material, the ink jet energy generating part's deformation (displacement) will not be restricted by the filler material if the filler material is provided in the gap of the ink jet energy generating parts, enabling a sure ink jetting.

Further, the present invention may use a material that has elastic and anti-ink properties as the filler material described above in the ink jet recording head production method described above.

According to the ink jet record head production method described above, by using a material that has elastic and anti-ink properties as the filler material, an ink leakage from the pressure chamber is protected by the filler material.

That is, in a rare case, a pinhole or the likes are formed in the vibrating plate that is exposed from the opening part by performing the removal step. In this case, the ink in the pressure chamber oozes from the pinhole, causing a fault such as a shorted circuit or the like at an electric part of the ink jet energy generating part (piezoelectric element). Whereas, even if there is a pinhole in the vibrating plate, it is acceptable if it functions without a problem, ink-oozing prevented.

Therefore, by providing the filler material that has elastic and anti-ink properties between the ink jet energy generating parts in the opening part, ink oozing is protected without hindering the driving (deformation, displacement) of the ink jet energy generating part.

Further, the present invention may perform the removal step described above after the bonding step described above in the ink jet recording head production method.

According to the ink jet recording head production method described above, b performing the removal step after the bonding step is finished, when the opening part is formed in the removal step, the status of the rear side of the base plate is such that it is bonded to the main body. For this reason, when the opening part is formed, the ink jet energy generating part formed on the base board is protected from damages, enabling to enhance yields and reliability.

Further the present invention may perform the nozzle plate installation step either before or after the bonding step described above in the ink jet recording head production method.

Further the present invention may additionally perform a heat dissipation part forming step wherein a material with a high heat conductivity is provided at the opening part formed on the base plate described above after the removal step described above in the ink jet recording head production method described above.

According to the ink jet recording head production method described above, by providing a material with a high heat conductivity at the opening part formed on the base plate through the heat dissipating part forming step after the removal step, an efficient heat dissipation of heat generated at the ink jet energy generating part is enabled, thereby enabling a high-speed printing.

Further, to achieve the object described above, the present invention may take a structure in the ink jet recording head that spouts ink from the pressure chamber, wherein the piezoelectric element is provided, which is formed by a growth step in which the piezoelectric element is grown on the base plate using the thin film forming technology, and a removal step in which the base plate of the deforming part of the piezoelectric element described above is removed, while leaving the base plate at the peripherals of deforming part of the piezoelectric element described above.

Further, to achieve the object described above, the present invention may take a structure wherein an ink jet recording head is provided, which uses a piezoelectric element that is formed by the growth step in which the piezoelectric element described above is formed on the base plate using the thin film forming technology and the removal step in which the deforming part of the piezoelectric element described above of the base plate is removed, while leaving the base plate at the peripherals of the deforming part of the piezoelectric element described above, in a printer apparatus that uses an ink jet recording head that spouts the ink from the pressure chamber described above by deforming the piezoelectric element by an electrical signal, comprising a pressure chamber and a piezoelectric element.

BRIEF DESCRIPTION OF THE DRAWINGS

Other purposes, features and advantages of the present invention will be clarified when following detailed description is read with reference to attached drawings.

BEST MODE EMBODIMENT OF THE INVENTION

In the following, embodiments of the present invention will be described with reference to the drawings.

Figure 3:
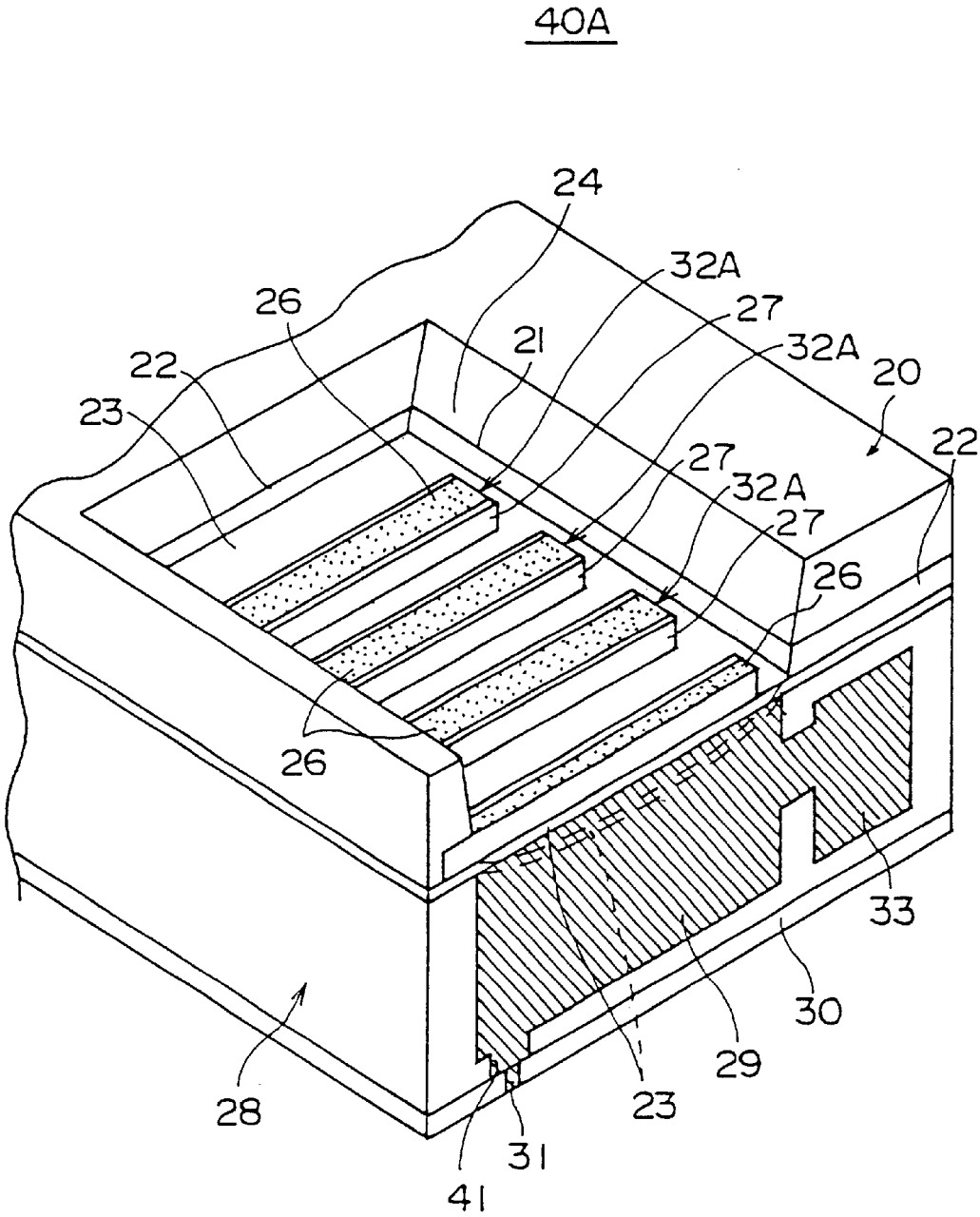
FIG. 3 is an oblique angle and cross-sectional drawing of the ink jet recording head of a first embodiment example of the present invention.
Figure 4:
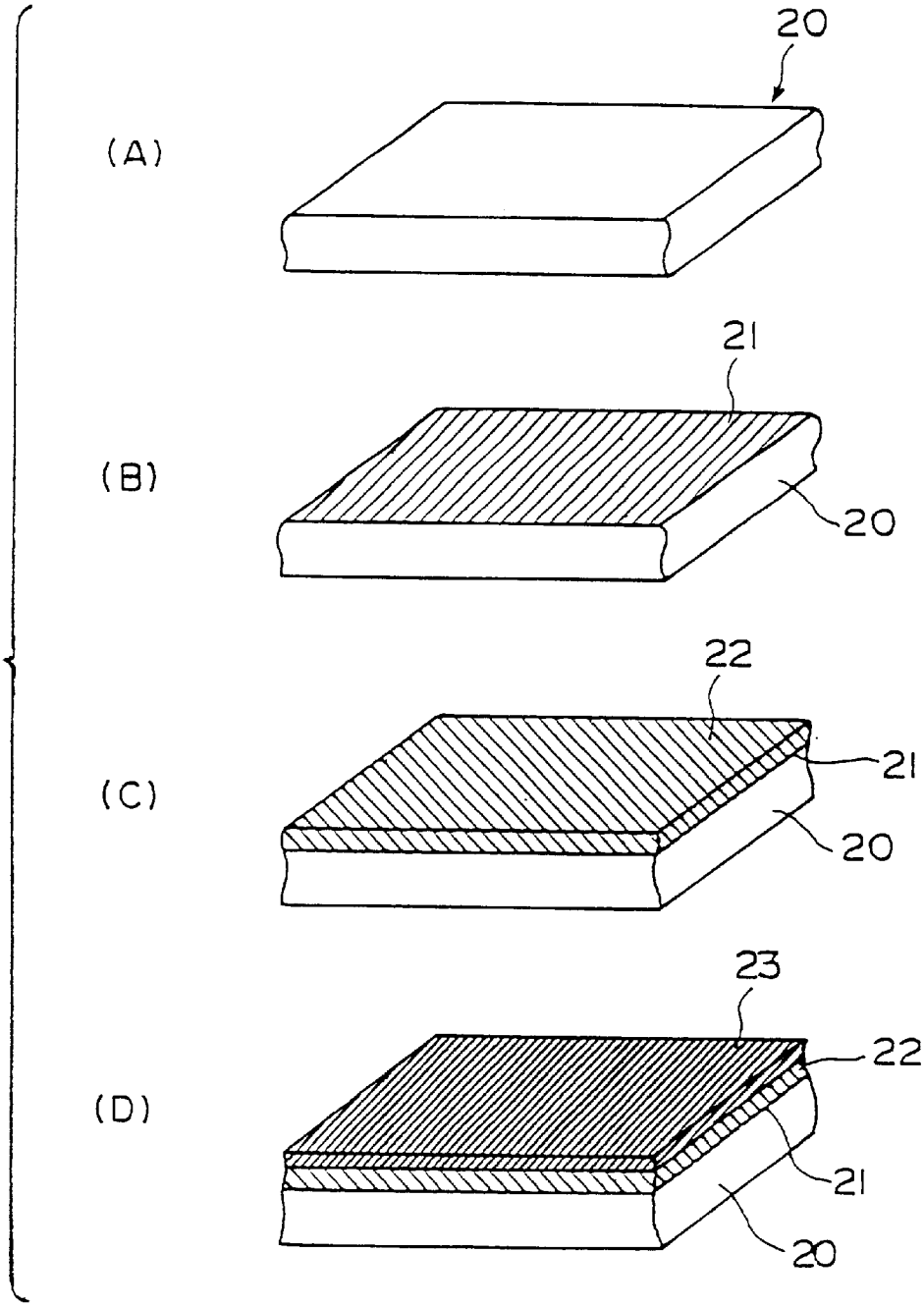
FIG. 4 is a drawing to explain a production method of the ink jet recording head of the first embodiment example.
Figure 4:
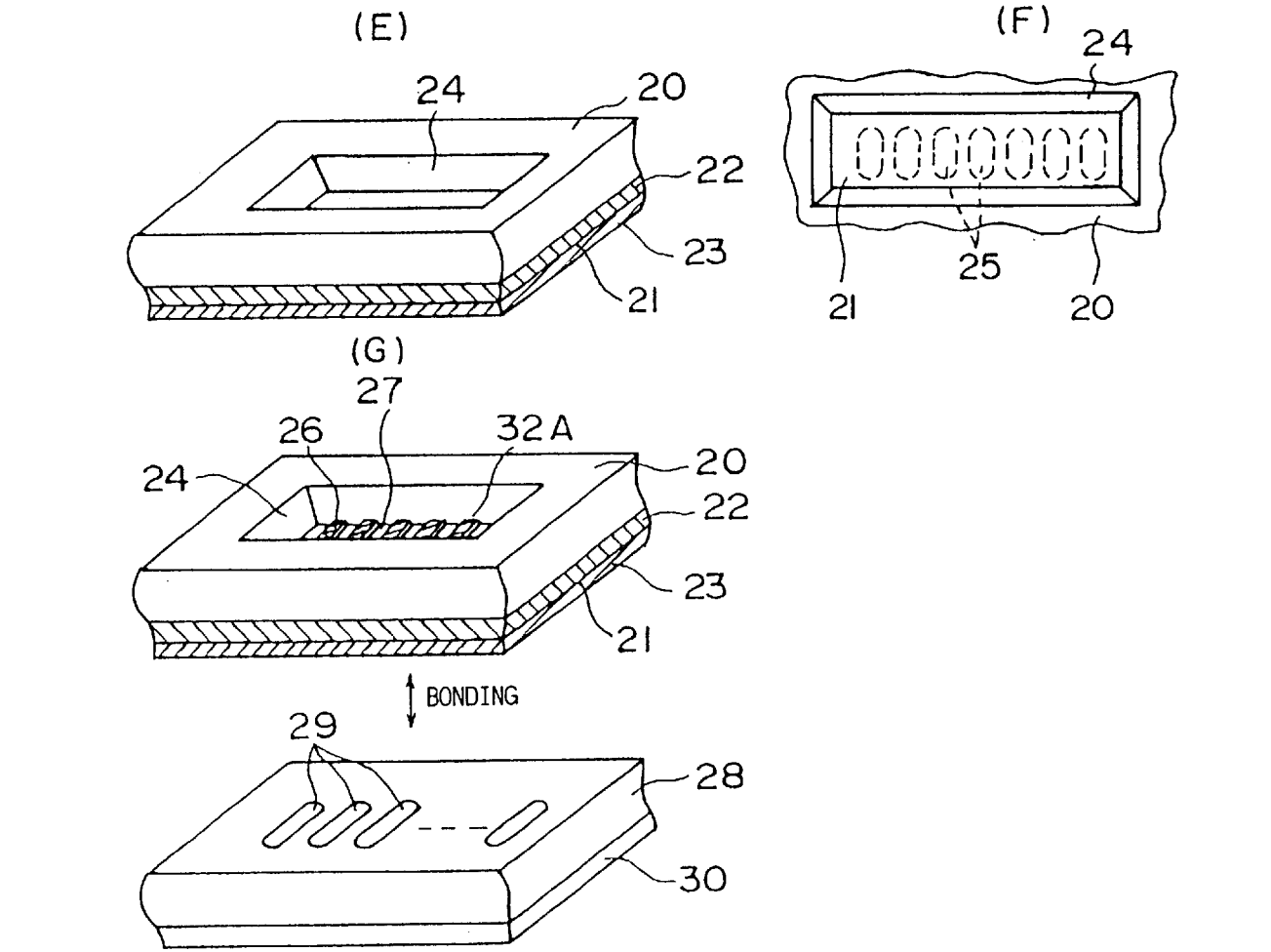

FIG. 3 is a drawing that shows an ink jet recording head 40A of the first embodiment example of the present invention. And, FIG. 4 is a drawing to explain a production method of the ink jet recording head of the first embodiment example of the present invention, showing the production method of the ink jet recording head 40A shown in FIG. 3 in this embodiment example.

In the following embodiment examples, explanations are made on examples that use a piezoelectric element as an energy generating means, however, a thermal element may be used in place of the piezoelectric element.

First, the structure of the ink jet recording head 40A is described with reference to FIG. 3.

The ink jet recording head 40A, in brief, comprises a base plate 20, a vibrating plate 23, a main body 28, a nozzle plate 30 and an ink jet energy generating part 32A (to be called an energy generating part hereinafter) or the like.

The main body 28 has a dry film layered structure as described hereafter, in which a plurality of compression chambers (ink chambers) 29 and ink paths 33 which are ink supply routes are formed. Further, the upper part in the drawing of the pressure chambers 29 is an opening part and ink jet hole 41 are formed on the bottom surface thereof.

Further, the nozzle plate 30 is provided on the bottom surface of the drawing of the main body 28 and the vibrating plate 23 is provided on the top surface. The nozzle plate 30 is made of, for example, stainless steel and a nozzle 31 is formed at a position that faces to the ink jet hole 41.

Further, the vibrating plate 23 is a plate-like material that is flexible and made of, for example, chrome (Cr), on which the base plate 20 and energy generating parts 32A are provided. The base plate is made of, for example, magnesium oxide (MgO), at the center position of which an opening part 24 is formed. The energy generating part 32A is formed on the vibrating plate 23 that is exposed by the opening part 24.

The energy generating part 32A comprises the vibrating plate 23 described above (functions also as a common electrode), individual electrodes 26, and piezoelectric elements 27. The energy generating part 32A is formed in a position corresponding to the forming position of the pressure chamber 29 that is formed in plurality in the main body 28.

The individual electrodes are made of, for example, platina (Pt) and formed on the top surface of the piezoelectric elements 27. The piezoelectric elements 27 are crystal elements that generate piezoelectricity and are structured such that they are independently formed to each of the pressure chamber 29 forming positions in the present embodiment example (that is, adjacent energy generating parts 32A are not contiguous).

In the ink jet recording head 40A structured as described above, when a voltage is applied between the vibrating plate 23 that functions as the common electrode and the individual electrodes 26, the piezoelectric elements 27 generate distortions by the piezoelectric phenomenon. In this manner, when the piezoelectric elements generate distortions, the vibrating plate 23 deforms accordingly.

At this time, the vibrating plate is so structured as to bend as shown by the broken lines in the drawing, that is, to bend to the direction of the pressure chamber 29 upon the distortion generated by the piezoelectric element 27. Accordingly, the structure is such that, by the deformation of the vibrating plate 23 associated with the distortion of the piezoelectric element 27, the ink in the pressure chamber 29 is pressurized and spouted to outside via the ink jet hole 41 and the nozzle 31, to perform printing to recording media.

In the structure described above, the ink jet recording head 40A relative to the present embodiment example has a feature that the vibrating plate 23 and the energy generating part 32A (individual electrodes 26, piezoelectric elements 27) are formed by the thin film forming technology (detailed production method will be described later).

In this manner, the thin and fine energy generating part 32A can be formed with a high precision and a high reliability by forming the vibrating plate 23 and the energy generating part 32A by the thin film forming technology. Accordingly, a low power consumption of the ink jet recording head 40A can be served and a high resolution printing is enabled.

Further, in the present embodiment example, the structure is such that the piezoelectric elements 27 are divided for each of the energy generating parts 32A. That is, each energy generating part 32A can displace without restrictions from adjacent energy generating parts 32A. Accordingly, the voltage applied that is necessary for ink jetting can be lowered, thereby the reduced power consumption of the ink jet recording head 40A can be served.

Next, the production method of the ink jet recording head 40A with the structure described above is presented using FIG. 4.

To produce the ink jet recording head 40A, the base plate 20 as shown in FIG. 4(A) is prepared. In the present embodiment example, a 0.3 mm thick monocrystal element of magnesium oxide (MgO) is used as the base plate 20.

On the base plate 20, the individual electrode layer 21 (to be simply called electrode layer hereafter), the energy generating layer 22 (to be called piezoelectric element layer because the present embodiment example uses the piezoelectric element) and the vibrating plate 23 are sequentially formed (making a part of an energy generating part forming step), using the spattering method that is a thin film forming technology.

Specifically, the electrode layer 21 is formed on the base board 20 as shown in FIG. 4(B), then, as shown in FIG. 4(C) the piezoelectric element layer 22 is formed on the electrode layer, further the vibrating element 23 is formed on the piezoelectric element layer 22. In the present embodiment example, platina (Pt) as the material of the electrode layer 21 and Ni—Cr, Cr or the like as the material for the vibrating plate are used.

When the forming steps of each of layers 21 through 23 that employs the thin film forming technology have been finished as described above, then as shown in FIG. 4(E), the base board 20 is turned upside down so that each of the layers 21 through 23 come on the bottom side and about the center part of the base plate 20 is removed by etching to form the opening part 24 (removal step).

The position of the opening part 24 is selected at least to correspond with the deforming portion of the vibrating plate to bend by the energy generating part 32A (refer to FIG. 3). In this manner, by forming the opening part 24 by removing the base plate, the electrode layer 21 is so structured as to be exposed from the base plate 20 via the opening part 24 as shown in FIG. 4(F).

When the opening part 24 is formed by performing the removal step as described above, then the energy generating parts 32A are formed by dividing both the electrode layer 21 that is exposed by the opening part 24 and the piezoelectric element layer 22 at a predetermined position (the position corresponding to the forming position of the pressure chambers 29) (dividing step: this dividing step is part of the energy generating part forming step).

The width of the energy generating part 32A is designed such that the energy generating part 32A covers a plurality of the pressure chambers 29 when the main body 28 is bonded to the base plate 20 in the bonding process to be performed later.

By performing the dividing step described above, the electrode layer 21 is divided into individual electrodes, thereby enabling an ink spouting control for each of the pressure chambers 29. Further, the piezoelectric layer 22 forms independent piezoelectric elements 27 through the dividing step. Whereas, the main body 28 and the nozzle plate 30 which the pressure chambers possesses are formed by performing a step separate from the step described above. The main body 28 which the pressure chambers possesses is formed by laminating a dry film (Tokyo Ohka Kogyo Co. made solution type dry film PR series) to the nozzle plate 30 (with alignment marks) and exposures for a number of necessary times developed (nozzle plate installation step).

Concrete forming method for the main body 28 is as follows. That is, a pattern of an ink path 33 (60 $\mu$m in diameter and 60 $\mu$m deep) which guides ink from the pressure chamber 29 to the nozzle 31 (a straight hole of 20 $\mu$m in diameter) and aligns the ink flow to a direction is exposed using the alignment marks of the nozzle plate 30, and then the pressure chamber 29 (100 $\mu$m wide, 1700 $\mu$m long and 60 $\mu$m thick) is exposed using the alignment marks of the nozzle plate 30 similarly to the ink path, and then left in under the room temperature for 10 minutes and thermal hardening (60 degrees C., 10 minutes) is performed, and unnecessary part of the dry film is removed by solution development.

The main body provided with the nozzle plate 30 formed as described above is bonded to the vibrating plate 23 as shown in FIG. 4(G) (bonding fixing). At this occasion, the pressure chamber 29 and the energy generating part 32A are bonding process so as to face each other accurately.

As described above, according to the present embodiment example, the electrode layer 21, the piezoelectric layer 22, and the vibrating plate 23 are sequentially formed on the base plate 20 using the think film forming technology such as spattering or the like, thereby the energy generating part 32A that is thinner than before can be formed with a high accuracy and a high reliability.

Further, between the layers 21 through 23, there is no bonding materials such as adhesives or the like intervening, thereby enabling to form the energy generating part 32A with a high degree of flatness, dispensing with absorption of the piezoelectric element's displacement as was the case conventionally. Accordingly, the ink jet recording head 40A that can serve a lower consumption power and a higher resolution of printing can be realized. Further, by flattening the vibrating plate 23, the closeness between the piezoelectric element 27 and the vibrating plate is enhanced, enabling to realize the ink jet recording head 40A of a good driving without unevenness.

Figure 1:
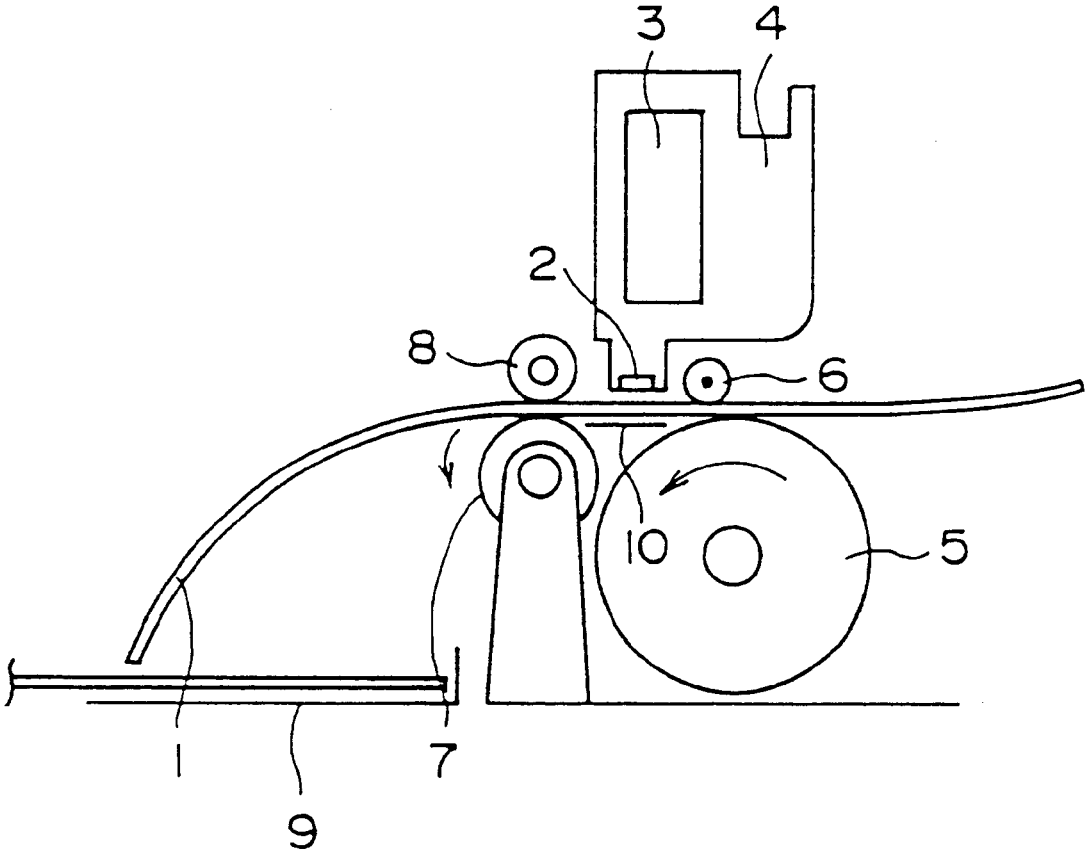
FIG. 1 is a main structure drawing of an example of a printer apparatus.
Figure 2:
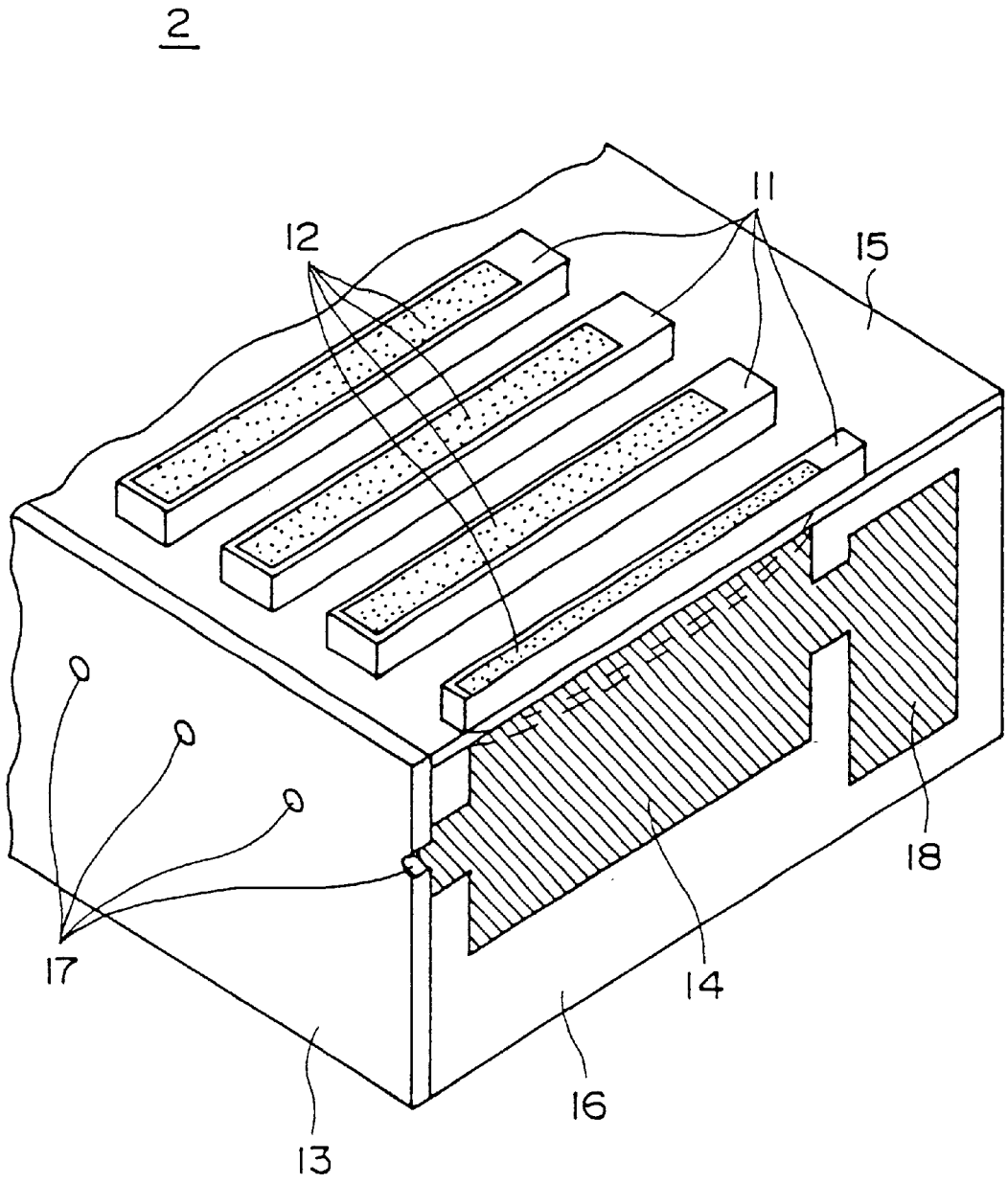
FIG. 2 is an oblique angle and cross-sectional drawing of a sample of the conventional ink jet recording head.

Further, in the removal step described above, the opening part 24 is formed by removing the predetermined part of the base plate 20, thereby exposing the energy generating part 32A from the base plate 20, a protection of the energy 32A can be performed as compared with the conventional structure (refer to FIG. 2) wherein the piezoelectric element 11 or the like simply exposed. Accordingly, if the energy generating part 32A is made thin, it does not get damaged, thereby enhancing the reliability of the ink jet recording head 40A.

Further, in the present embodiment example, by forming the individual electrodes 26 and the piezoelectric elements 27 by dividing both the electrode layer 21 exposed in the opening part 24 and the piezoelectric layer 22, adjacent energy generating parts 32A are of completely independent structure. Accordingly, the deformability (drivability) of the energy generating part 32A upon a voltage application is enhanced, enabling a highly responsive ink jetting.

Further, in the present embodiment example described above, the energy generating part 32A is formed over a plurality of pressure chambers 29, thereby the energy generating part 32A is supported by the base plate 20 at the peripherals of the pressure chambers 29. Accordingly, the strength of the energy generating part 32A is enhanced and the reliability of the ink jet recording head 40A is enhanced.

Next, a description of an ink jet recording head 40B that is a second embodiment example of the present invention and production method therefor will be described with reference to FIG. 5 and FIG. 6.

Figure 5:
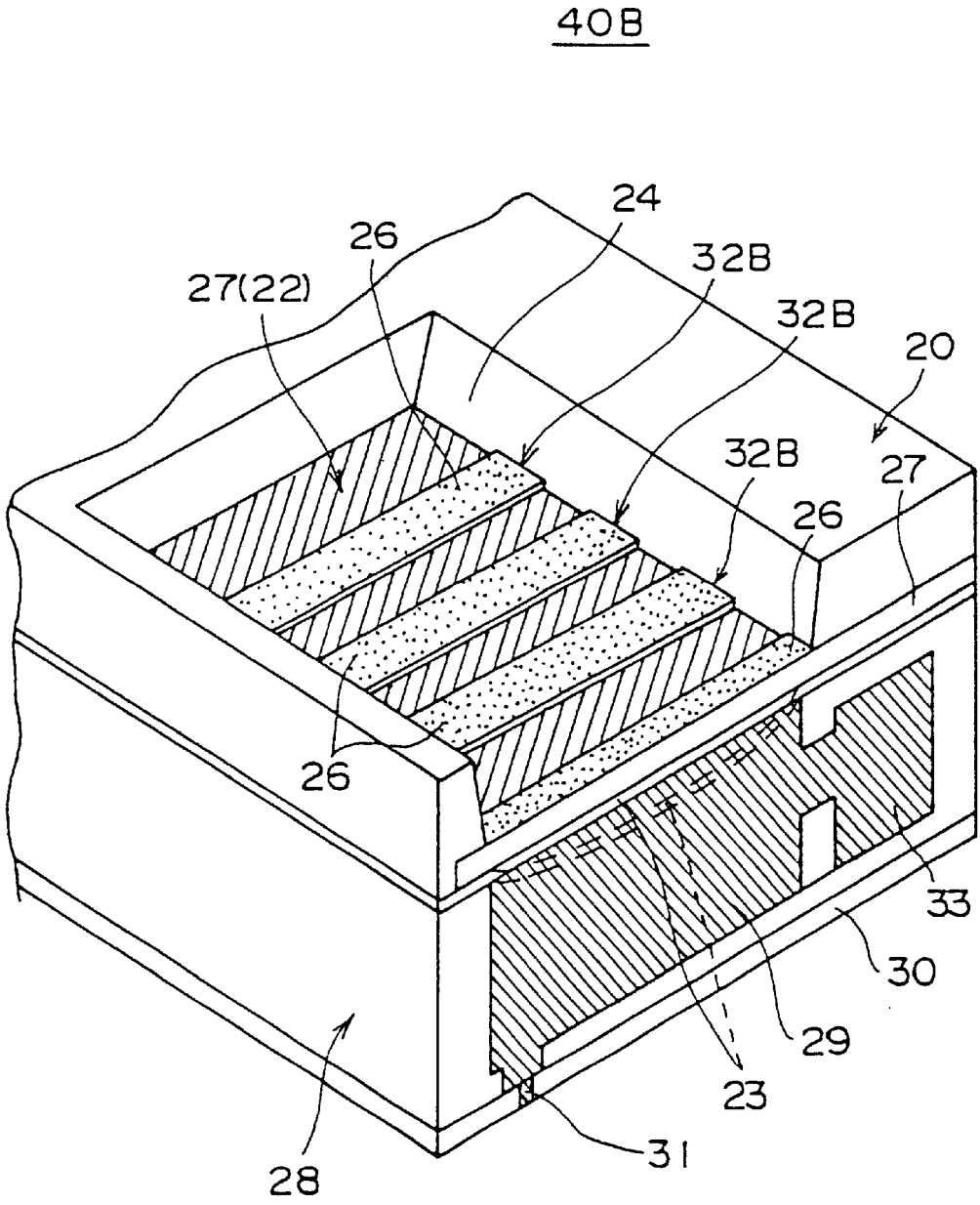
FIG. 5 is an oblique angle and cross-sectional drawing of the ink jet recording head of a second embodiment example of the present invention.
Figure 6:
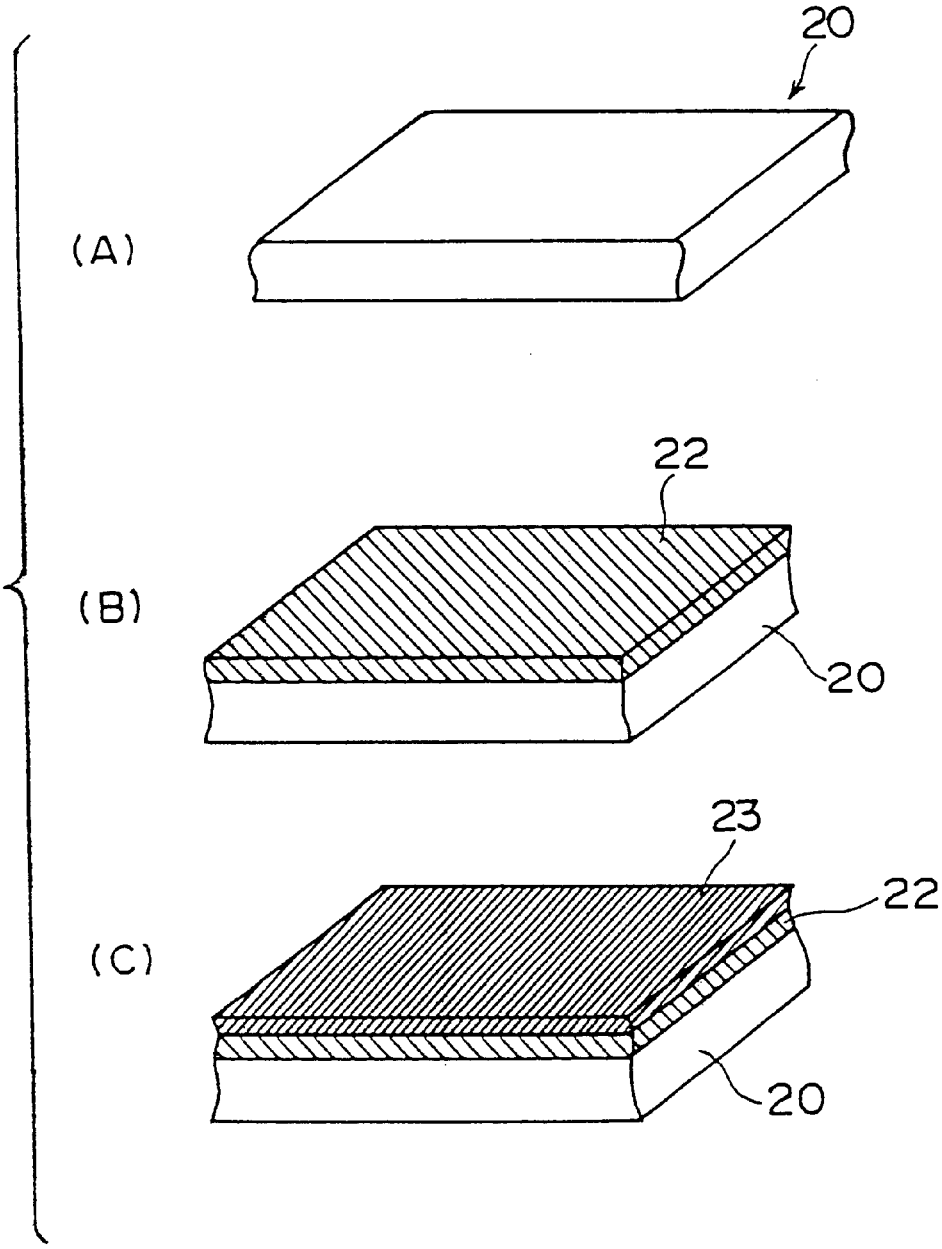
FIG. 6 is a drawing to explain a production method of the ink jet recording head of the second embodiment example.
Figure 6:
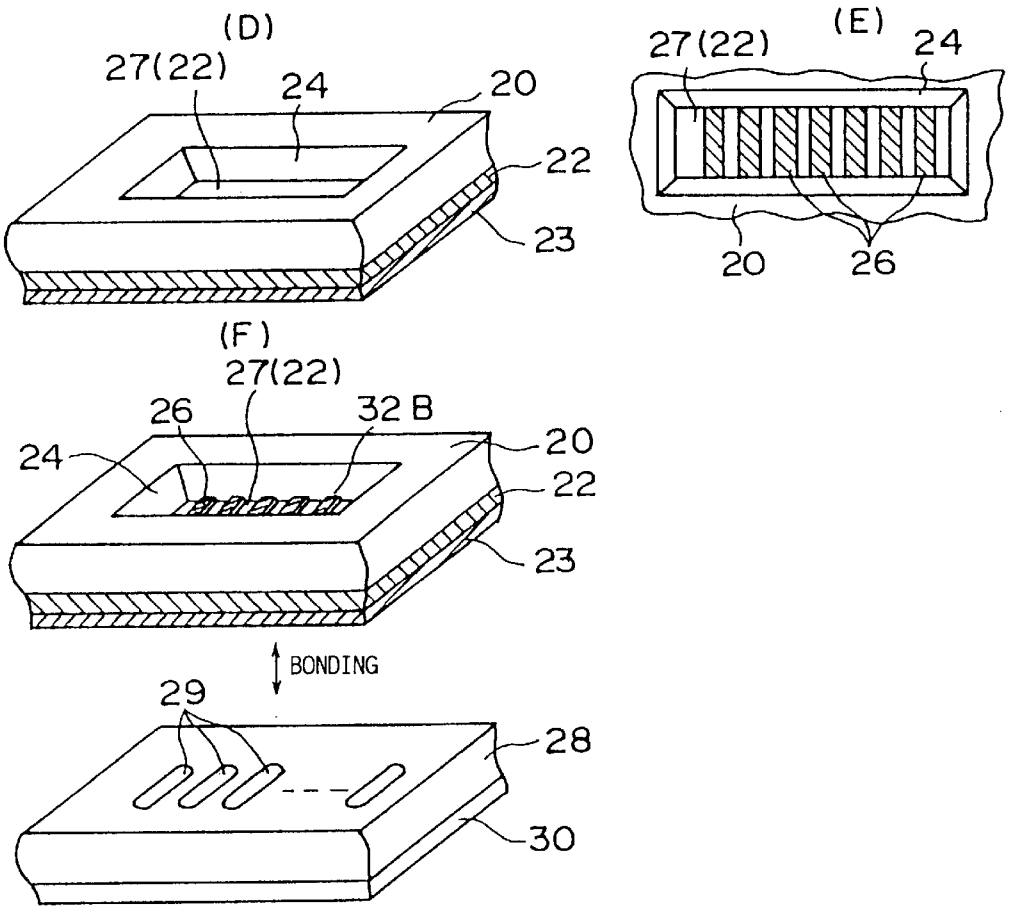

FIG. 5 shows the ink jet recording head 40B that is the second embodiment example of the present invention. FIG. 6 is a drawing to describe the production method of the ink jet recording head 40B that is the second embodiment example of the present invention.

In each of the following embodiment examples, where the same structure applies as the structure of the ink jet recording head 40A relative to the first embodiment example as described using FIG. 3, the same number is attached and skip description thereof. Similarly, in each of embodiment examples to be described hereunder, descriptions will be omitted for a same step that is the same production step relative to the first embodiment example described using FIG. 4.

As shown in FIG. 5, the ink jet recording head 40B relative to the present embodiment example, its structure is such that the piezoelectric element is not divided, only the individual electrodes are divided corresponding to the pressure chambers 29. Accordingly, the structure is such that the piezoelectric element 27 is present between adjacent individual electrodes 26. Further, as described in detail later, the individual electrodes 26 are formed after the opening part 24 is formed.

Next, the production method of the ink jet recording head 40B as structured above is described.

In the production method of the first embodiment example described above, the electrode layer 21 was formed on the base plate 20 as the first step (refer to FIG. 4(B)). The present embodiment example features that at first the piezoelectric layer 22 is formed on the base plate 20 using the spattering method (FIG. 6(B)). That is, in this embodiment example, the structure is that the piezoelectric layer 22 is formed directly on the top surface of the base plate 20. In this case, the top surface of the base plate 20 is set to be the [100] face.

Further, in the present embodiment example, a feature is that the individual electrode forming step in which the individual electrodes 26 are formed is performed after the removal step is finished (that is, after the opening part 24 is formed) as shown in FIGS. 6(E) and (F).

As described above, the piezoelectric element 27 (the piezoelectric layer 22) is exposed at the opening part 24 when the opening part 24 is formed as shown in FIG. 6(D) by forming the piezoelectric layer 22 on the top surface of the base plate 20 without forming the electrode layer 21.

The individual electrodes 26 are formed on the top surface of the piezoelectric element 27 (the piezoelectric layer 22) via the opening part 24 using the thin film forming technology. At this time, the forming position of the individual electrodes 26 is set at a position corresponding to the predetermined forming position of energy generating part 32B.

By forming the piezoelectric element 27 (the piezoelectric layer 22) and the vibrating plate 23 on the base plate 20 sequentially using the thin film forming technology as in the present embodiment example, the piezoelectric element 27 (the piezoelectric layer 22) can be grown in a monocrystal state according to the lattice constant of the base plate 20 (the lattice constant is not uniform but has an internal distortion).

If a metal electrode layer (the electrode layer 21) that does not have a crystal lattice is present between the base plate and the piezoelectric element 27 (the piezoelectric layer 22) as in the first embodiment example, the lattice of the piezoelectric element 27 (the piezoelectric layer 22) is deformed when it is formed, creating a situation wherein a good jet energy cannot be obtained.

Whereas, an outcome is a formation of the piezoelectric element 27 (the piezoelectric layer 22) with required lattice constant by forming the individual electrode 26 on the surface of the piezoelectric element 27 (the piezoelectric layer 22) that is exposed from the opening part 24, after the opening part 24 is formed in the base plate 20 in the removal step.

Figure 7:
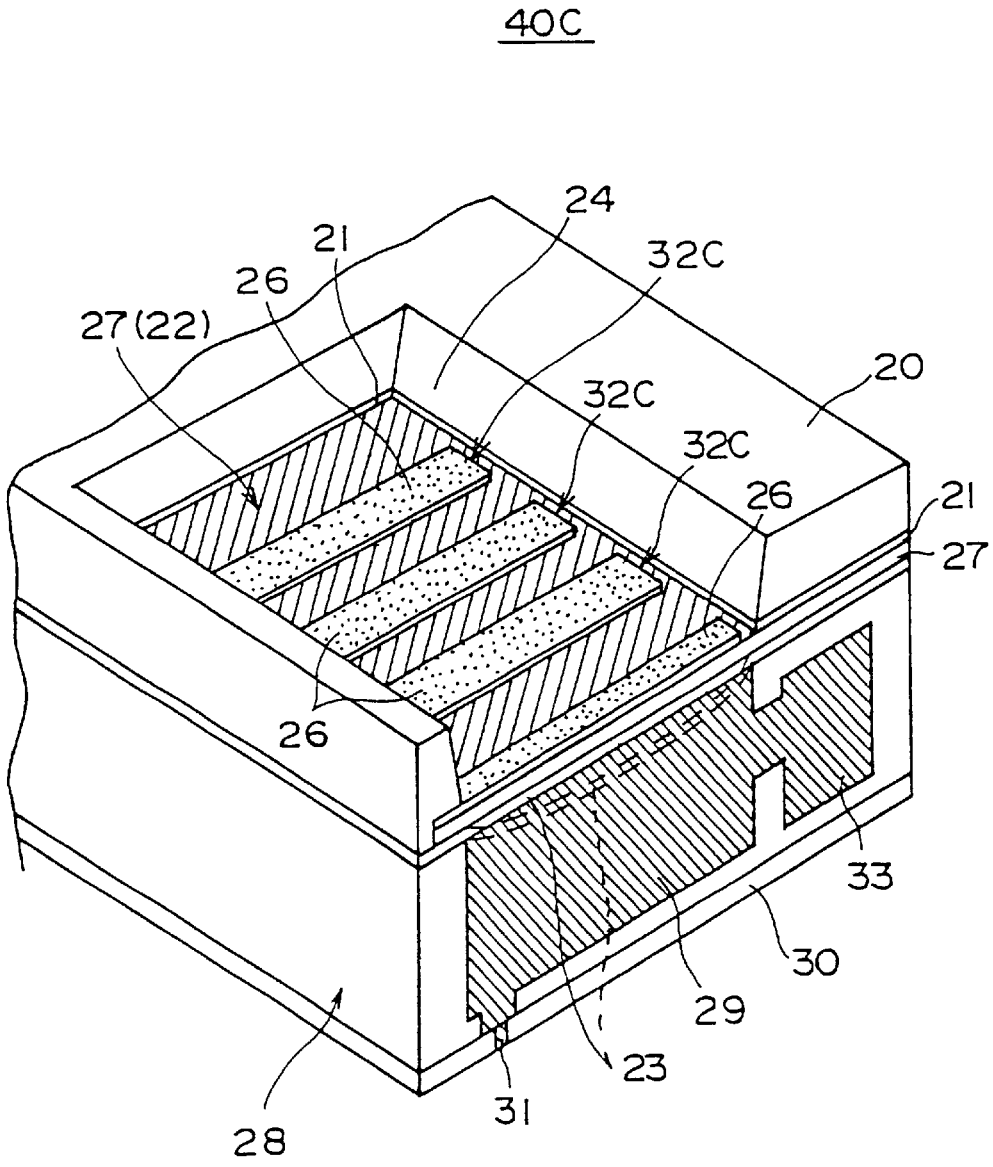
FIG. 7 is an oblique angle and cross-sectional drawing of the ink jet recording head of a third embodiment example of the present invention.
Figure 8:
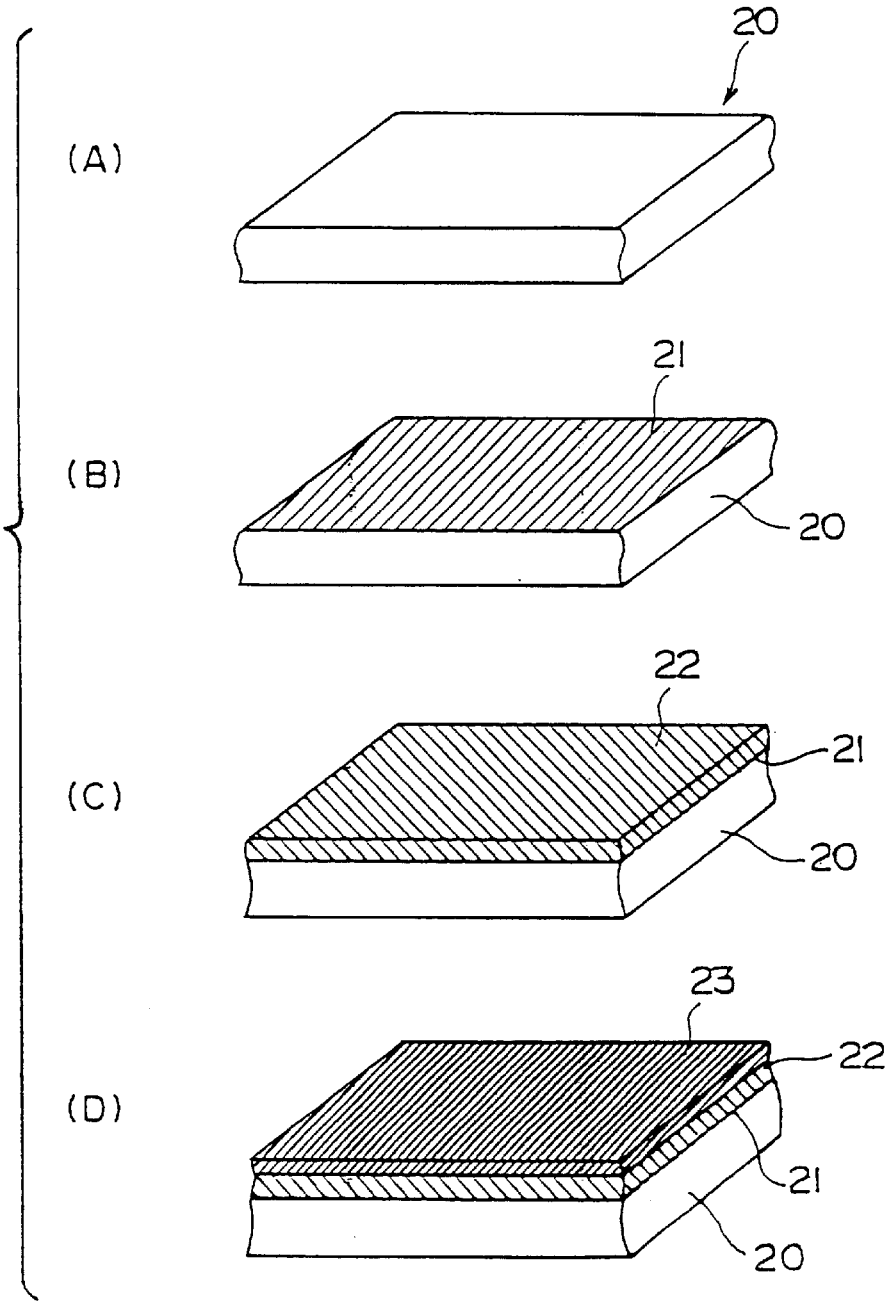
FIG. 8 is a drawing to explain a production method of the ink jet recording head of the third embodiment example.
Figure 8:
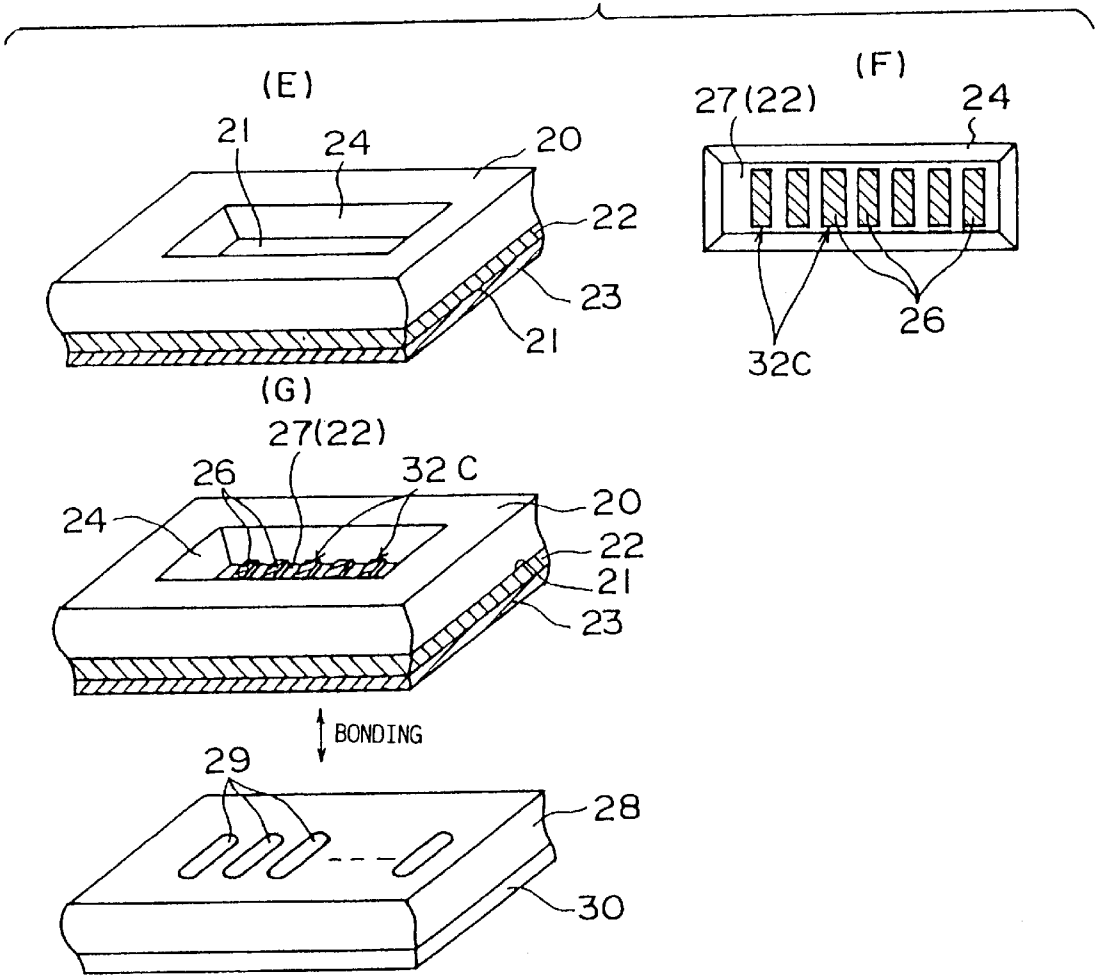

Next, a description follows about an ink jet recording head 40C and production method therefor using FIG. 7 and FIG. 8.

FIG. 7 is a drawing that shows the ink jet recording head 40C that is a third embodiment example of the present invention. FIG. 8 is a drawing to describe the production method of the ink jet recording head 40C that is the third embodiment example of the present invention.

As shown in FIG. 7, the ink jet recording head 40C is structured such that the piezoelectric element 27 (the piezoelectric layer 22) is not divided but only the individual electrodes are divisionally formed in correspondence with the pressure chambers 29, similarly to the ink jet recording head 40B that is the second embodiment example.

Next, the production method of the ink jet recording head 40C structured as described above is described. The production steps of FIGS. 8(A) through (E) are the same as the first embodiment example. Accordingly, in the opening part 24 formed by performing the removal step, the status of the electrode layer 21 is exposed.

In the production method relative to the present embodiment example, a feature is that the dividing step is performed after the removal step is finished, and the individual electrodes 26 are formed by dividing only the electrode layer 21 that is exposed at the opening part 24 at the forming position of an energy generating part 32C (refer to FIG. 7 and FIG. 8(F). Further, a feature is that the dividing position of the electrode layer 21 when the individual electrodes 26 are formed is set at between adjacent pressure chambers 29.

By performing the dividing step after the removal step is finished to form the individual electrodes 26 by dividing only the electrode layer 21 that is exposed to the opening part 24 as in the present embodiment example, it is possible to form the energy generating part 32C that has a small amount of internal distortions.

That is, in a method wherein the dividing step is divided before the piezoelectric element layer 22 is provided to form the individual electrode 26, a portion where the piezoelectric element layer 22 is layered directly on the base plate 20 and another portion where the piezoelectric element layer 22 is layered on the individual electrodes 26 are produced.

In this structure, internal distortions due to difference in the lattice constant tend to be created to the piezoelectric layer 22. And, if the opening part 24 is formed at the base plate 20 keeping the situation where there are internal distortions, damages (cracks and deformation) can happen due to the internal distortions at the thin film part after the removal.

Whereas, if the piezoelectric element layer 22 is formed together with the electrode layer 21 on the whole surface of the base plate 20 and the electrode layer 21 is divided after the removal step is finished as the present embodiment example, the piezoelectric element layer 22 with a small amount of internal distortions can be formed, thereby enhancing the reliability of the ink jet recording head 40C to be produced.

Further, the dividing process can be performed dependably by setting the dividing position to divide process the electrode layer 21 in the dividing step at between adjacent pressure chambers 29. That is, because the pressure room 29 is a vacant part, the electrode layer 21 and the piezoelectric element layer 22 are structured such that they are supported only by the thin vibrating plate 23. Accordingly, if the dividing process is performed on the forming part of the pressure chambers 29 which are vacant part, there is a possibility to create damages such as cracks to the vibrating plate 23.

Whereas, by setting the dividing position of the electrode layer 21 at between adjacent pressure chambers 29 as in the present embodiment example, the dividing position is a position on the main body 28 not the pressure chambers 29. That is, the energy generating part 32C is structured such that it is formed over the pressure chambers, thereby protecting the vibrating plate 23 from damages.

In the following, an ink jet recording head 40D that is a fourth embodiment example of the present invention and a production method therefor are described using FIG. 9 and FIG. 10.

Figure 9:
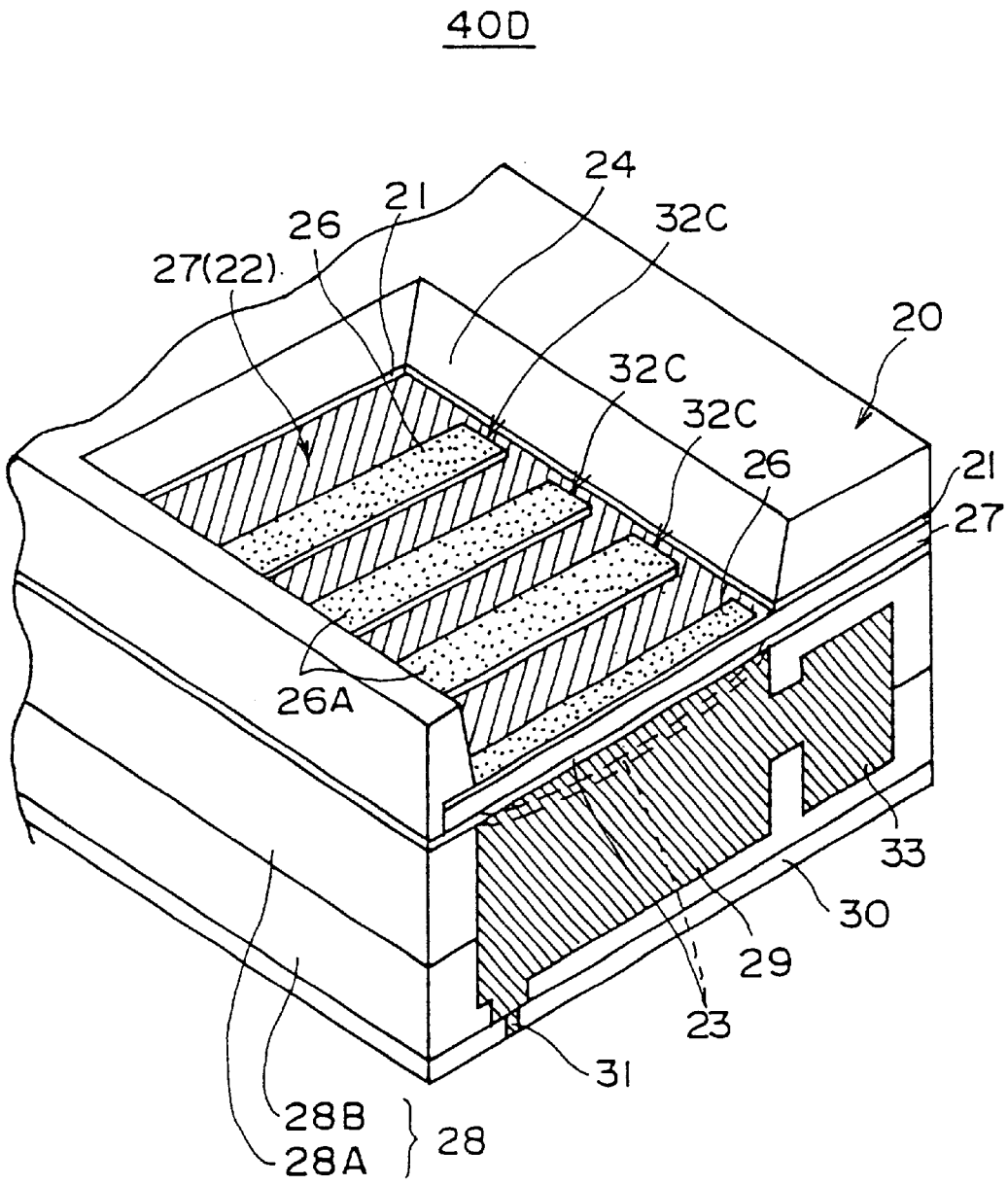
FIG. 9 is an oblique angle and cross-sectional drawing of the ink jet recording head of a fourth embodiment example of the present invention.
Figure 10:
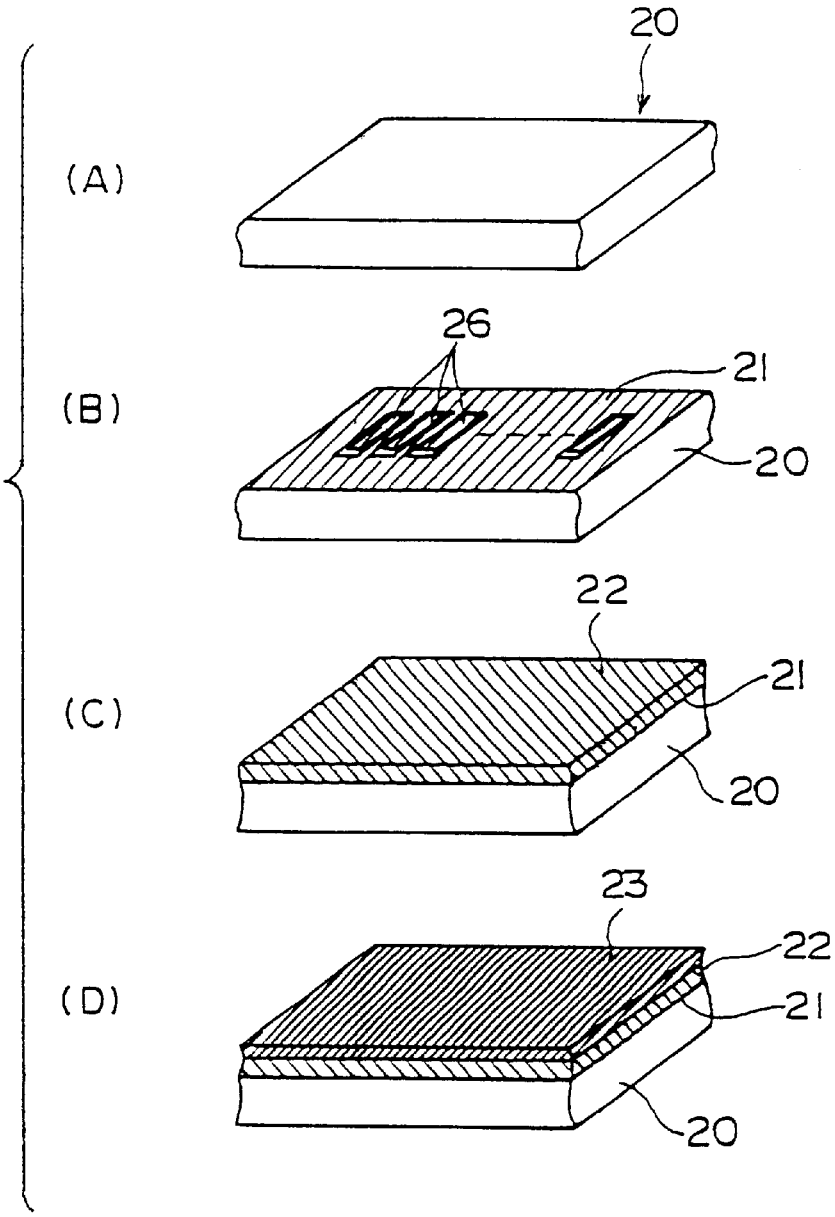
FIG. 10 is a drawing to explain a production method of the ink jet recording head of the fourth embodiment example.
Figure 10:
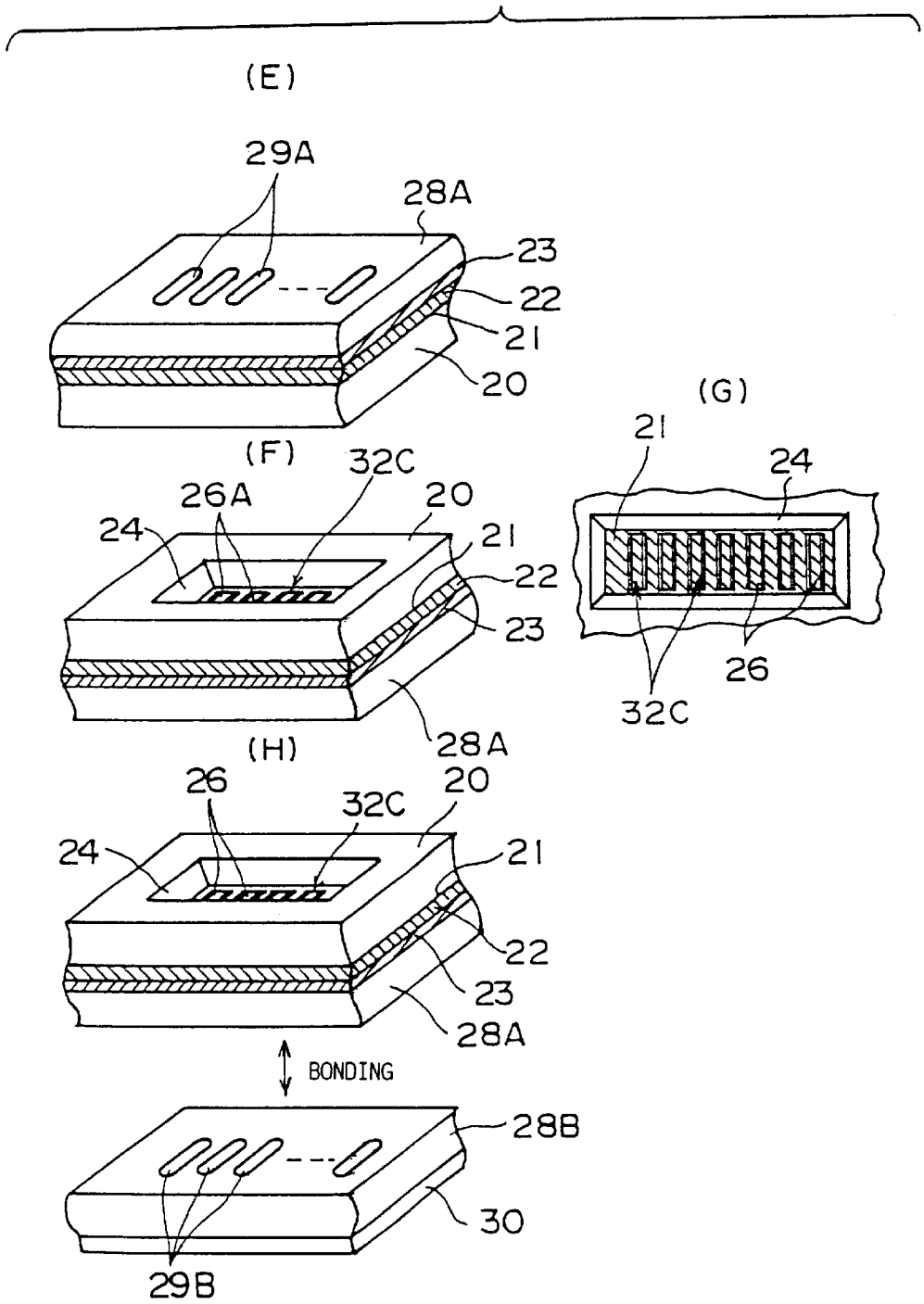

FIG. 9 is a drawing that shows the ink jet recording head 40D that is the fourth embodiment example of the present invention. FIG. 10 is a drawing to describe the production method of the ink jet recording head 40D that is the fourth embodiment example of the present invention.

As shown in FIG. 9, the ink jet recording head 40D relative to the present embodiment example is featured that the main body 28 is structured by a first main body half 28A and a second main body half bonded.

To produce the ink jet recording head 40D of this structure, first an about 300 μm thick base plate 20 of MgO with the top surface to be [100] face as shown in FIG. 13(A) is prepared. Then, on the top surface of the base plate 20, the electrode layer 21 is formed in an about 0.1 μm thickness of Pt using the spattering method.

Subsequently in the present embodiment example, the dividing step is performed before the piezoelectric element layer 22 is formed, and the individual electrodes 26 (dimensions: 80 μm×1900 μm, pitch 169 μm) are formed by dividing the electrode layer 21 at the forming position (refer to FIG. 9) of the energy generating part 32C as shown in FIG. 10(B). The formation of the individual electrodes 26 is performed by the photo-etching, and together with the formation of the individual electrodes 26, alignment marks (not shown) that are used in a bonding step described later are formed. And, after the individual electrodes are formed on the base plate 20, the piezoelectric element layer 22 (3 μm thick) and the vibrating plate 23 (2 μm thick) are formed sequentially using the thin film forming technology as shown in FIGS. 10(C) and (D). Subsequently, as shown in FIG. 10(E), the first main body half 28A is formed on the vibrating plate 23, using the alignment marks previously formed on the electrode layer 21 (a first bonding step). The first main body half 28A is formed by a dry film (Tokyo Ohka Kogyo Co.-made solution type dry film PR series) laminate-exposed for a necessary number of times and developed. At this occasion, a first pressure chamber half 29A and a half of the ink path 33 are formed together.

Subsequently, the base plate is turned up side down so that the first main body half 28A comes to the bottom, and a masking process is performed from the side of the base plate 10 using the alignment marks of the electrode layer 21 such that only the portion that corresponds to the pressure chambers is exposed.

When the masking process is finished, then the base plate 10 is etched by an acid etching solution (for example, 50% phosphoric acid) to form the opening part 24 as shown in FIG. 10(F) (removal step).

As described above, the individual electrodes 26 are formed by performing the dividing step immediately after the electrode layer 21 is formed on the base plate in the present embodiment example, thereby the structure is such that the individual electrodes 26 are exposed by forming the opening part 24. Accordingly, the individual electrodes 26 can be formed easier than the method previously described wherein the individual electrodes 26 are divided through the opening part 24.

Subsequently, as shown in FIG. 10(H), a second main body half 28B to which the nozzle plate 30 is provided is bonded to the first main body half 28A (a second bonding step). The second main body half 28B is formed under a step separate from the step described above.

That is, to form the second main body half 28B, to the nozzle plate 30 (with the alignment marks) laminate-exposure is performed for a necessary number of times to a dry film (Tokyo Ohka Kogyo Co.-made solution type dry film PR series) and developed. At the same time, a second pressure chamber half 29B and a half of the ink path 33 are formed together.

As described above, when the first main body half 28A is bonded to the second main body half 28B, position is decided using the alignment marks provided on each of the main body halves 28A and 28B for bonding. In this manner, each of the main body halves 28A and 28B can be bonded with a precise positioning. The bonding of the first and the second main body halves 28A and 28B were performed under a thermal hardening condition of a pressurization condition of 15 kgf/cm2, 150 degrees C. for 14 hours, for example.

Figure 12:
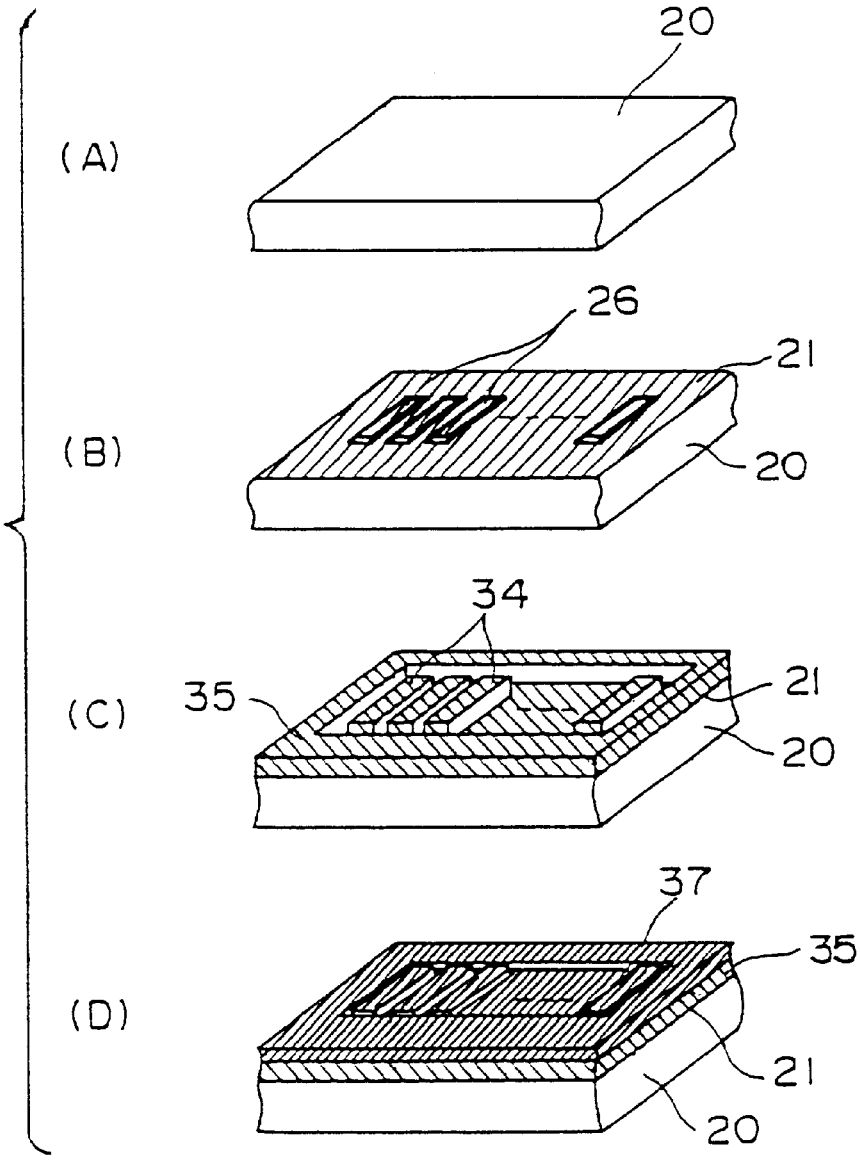
FIG. 12 is a drawing to explain a production method of the ink jet recording head of a sixth embodiment example.
Figure 12:
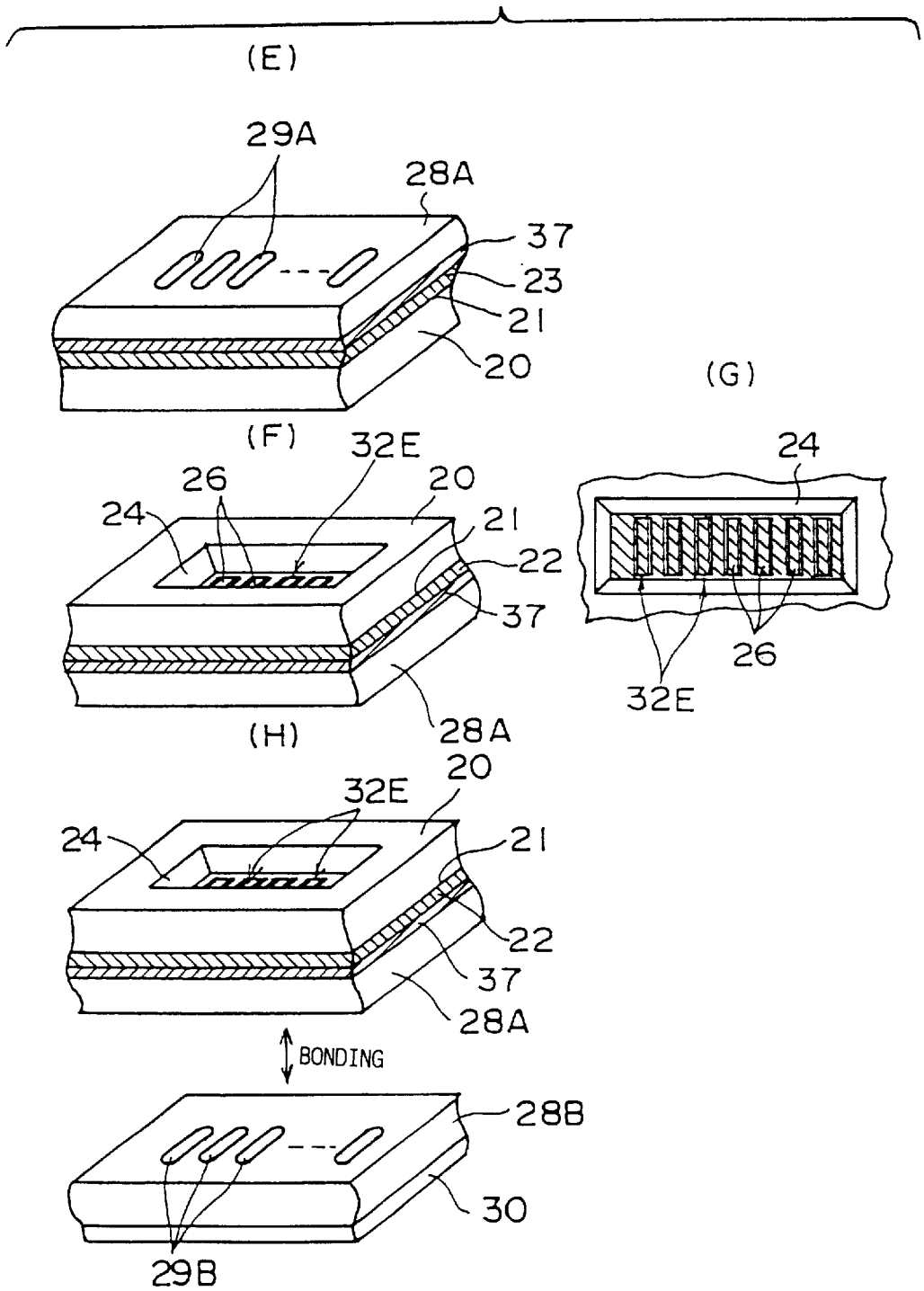

As described above, by bonding the first and the second main body halves 28A and 28B, the first and the second main body halves 28A and 28B jointly form the main body 28, further the first and the second pressure chamber halves 29A and 29B are bonded to form the pressure chamber 29, whereby the ink jet recording head 40D shown in FIG. 12 is produced.

As described above, the first bonding step is performed and the first main body half 28A is bonded onto the vibrating plate 23 before the removal step, thereby the structure is such that the base plate 10 is reinforced by the first main body half 28A during the removal step. Accordingly, when the opening part 24 is formed in the removal step, the first main body half 28A is present as a reinforcement material on the rear side of the opening part forming position, thereby enabling to protect the vibrating plate 23, the individual electrodes 26 and the piezoelectric element 27 or the like from damages.

Further, the mechanical strength of the energy generating part 32C that is exposed from the opening part 24 is weakened by forming the opening part 24, however, because of the presence of the first main body half 28A that functions as the reinforcement material on the rear side of the opening part forming position, the energy generating part 32C is protected from damages not only during the formation of the opening part but also after the formation of the opening part 24 is finished.

In the following, a production method of an ink jet recording head that is a fifth embodiment example of the present invention is described. Where the same step applies in the description of the present embodiment example to the production method of the ink jet recording head relative to the fourth embodiment, example described above, such a description will be omitted.

In the present embodiment example also, the electrode layer 21 (0.1 μm thick) is formed of Pt by the spattering method on the base plate 20 of MgO ([100] face, 300 μm thick). And then, the alignment marks and the individual electrodes 26 are formed in the formed electrode layer 21 by photo-etching (individual electrode forming step).

The alignment marks are used to determine positions in forming the pressure chambers 29 and in the bonding step, later. A plurality of the individual electrode parts 26 (dimensions 80 μm×1900 μm) is formed at a 169 μm pitch (FIG. 11(A), (B)).

Subsequently, a piezoelectric material is layered to the thickness of about 3 μm by the spattering method onto the electrode layer 21 on which the individual electrode parts 26 are formed, and the individual piezoelectric elements 34 and a frame part 35 are formed (individual energy generating layer forming step). The individual piezoelectric elements 34 are formed such that they are of the same dimensions as the individual electrode parts 26. The frame 35 is formed to enclose the perimeter of the base plate 20.

Figure 11:
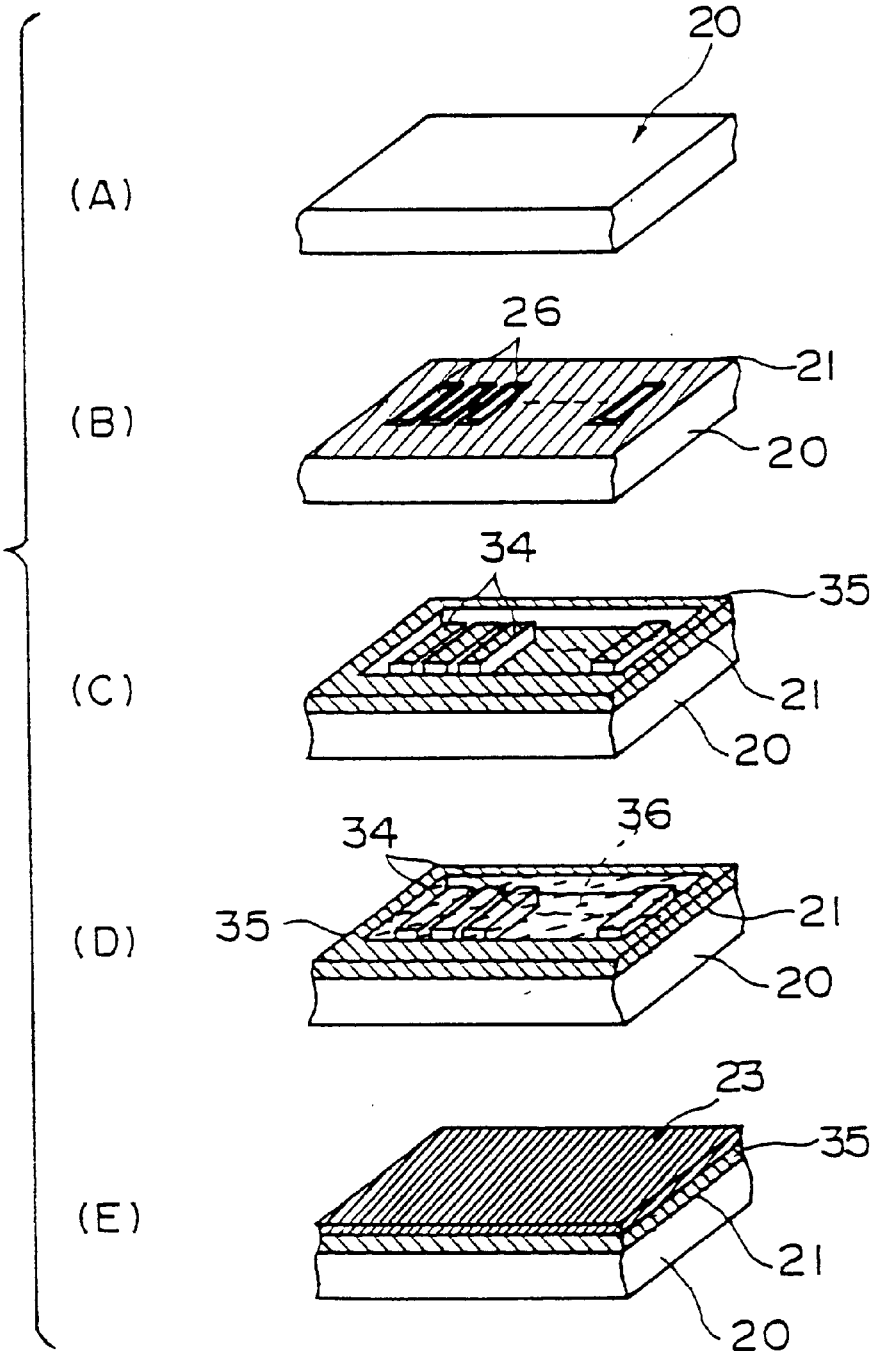
FIG. 11 is a drawing to explain a production method of the ink jet recording head of a fifth embodiment example.
Figure 11:
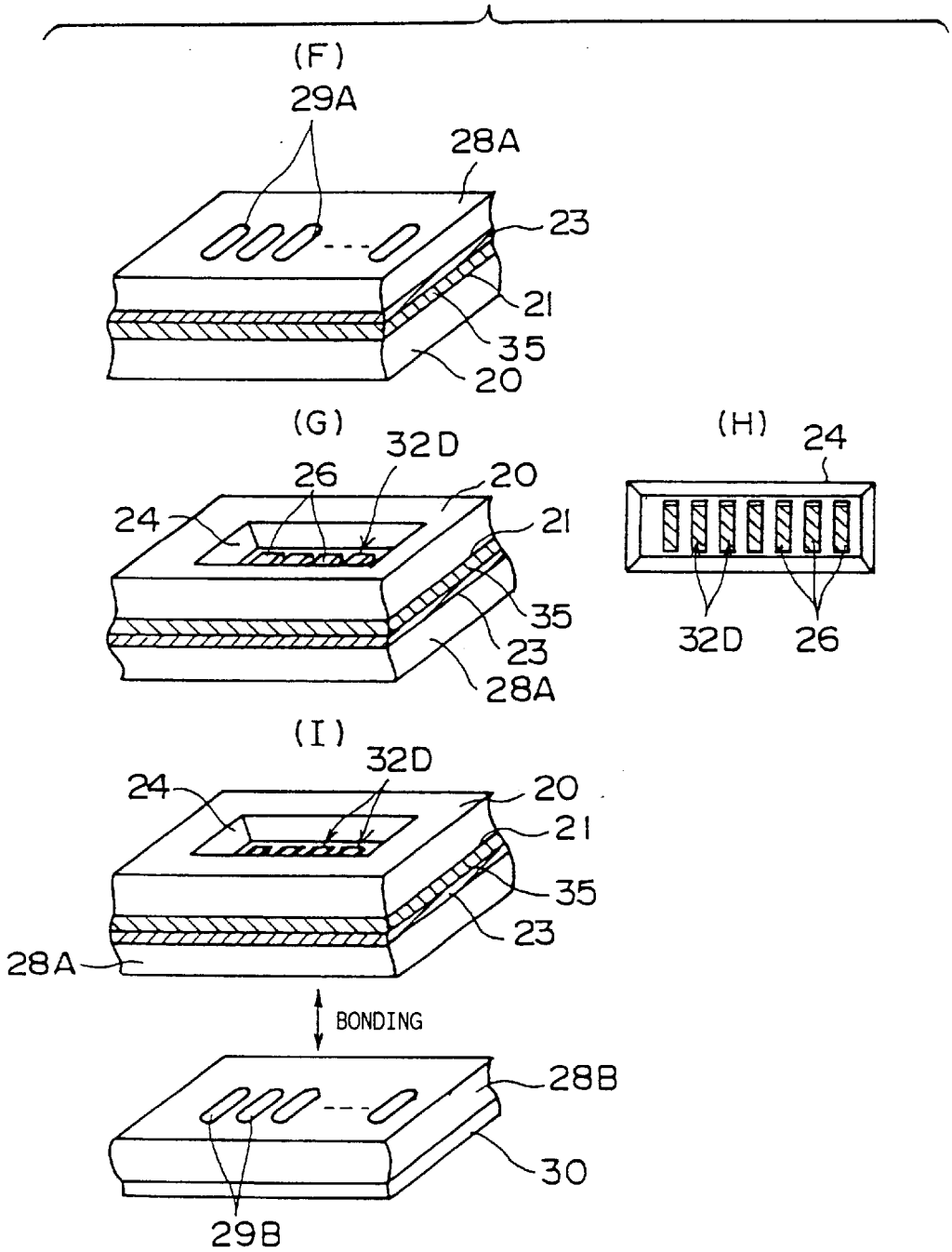

Under this condition, as shown in FIG. 11(C), intervals are formed between adjacent individual piezoelectric elements 34, and thereby there is a plurality of steps on the upper surface of the base plate 20.

Subsequently, spattering is performed with MgO as a target, and thereby a filler material 36 is formed between the adjacent individual piezoelectric elements 34 (filling step). At this time, the individual piezoelectric elements 34 and the frame 35 are masked so that the filler material 36 that is MgO is supplied only between the individual piezoelectric elements 34.

As described above, in the present embodiment example, the material same as that of the base plate 20 is used as the material of the filler material 36. Further, the thickness of the filler material is controlled in the spattering so as to make the thickness same as that of the individual piezoelectric elements 34 and the frame 35. Therefore, under the condition that the spattering material 36 is formed, the surface of the face jointly formed by the individual piezoelectric elements 34, the frame and the filler material becomes a flat surface.

When the filling step is finished as described above, subsequently, the 2 μm thick vibrating plate of Cr is spattered such that it covers the individual piezoelectric elements 34, the frame 35 and the filler material 36. In this manner, the energy generating part 32D (refer to FIG. 11(H)) is formed on the base plate 20.

By performing the filling step to form the filling material 36 between the adjacent individual piezoelectric elements 34, a smooth ink jetting is enabled. That is, if the vibrating plate is formed on the individual piezoelectric elements 34 that has unevenness without the filling material, the vibrating plate is subjected to bent at the uneven steps, which restricts the deformation of the energy generating part 32D, thereby causing a possible hindrance in ink jetting.

Whereas, by providing the filling material 36 in the filling step, the surface of the face that is jointly formed by the individual piezoelectric elements 34, the frame 35 and the filling material 36 becomes flat. By forming the vibrating plate 23 on the flat surface, a flat structure that is free from bent is obtained. By making the structure free from the bent, a smooth ink jetting is enabled.

When the vibrating plate 23 is formed as described above, subsequently, the first main body half 28A is provided in the upper part of the vibrating plate 23 (FIG. 11(D)) similarly to the fourth embodiment example described above, then the removal step is performed to form the opening part 24 against the base plate 20.

At this time, because the material of the filling material 36 is the same as that of the base plate 20, when the opening part 24 is formed during the removal step, the filling material of the position that corresponds to the opening part 24 is also removed together with the base plate 20. That is, the condition of each of the energy generating parts exposed from the opening part 24 is such that they are independent from each other.

In this manner, by structuring each energy generating part 32D independent, the drivability of each energy generating part 32D can be enhanced, thereby serving the low power consumption. Subsequently, the second main body half 28B which is provided with the nozzle plate 30 is bonded to the first main body half 28A to form the main body 28, similarly to the fourth embodiment example described above, thereby forming the ink jet recording head.

At this time, in the embodiment example described above, the structure was that the filling material 36 used the same material as the material of the base plate 20, it is possible to use other materials. For example, by using a material with a low Young's modulus, the filling material 36 will not disturb displacement (deformation) of the energy generating part 32D even if the filling material 36 is provided in the gap between adjacent energy generating parts 32D. Accordingly, by using the material with the low Young's modulus, low power consumption can be served as well as dependable ink jetting can be performed.

Further, by using a material with elastic and anti-ink properties as the filling material 36, ink oozing from the pressure chambers can be protected. That is, in a rare case, pinholes or the like are formed in the vibrating plate 23 that is exposed from the opening part 24 by performing the removal step.

In this case, ink in the pressure chamber 29 oozes out and can cause a fault from a shorted circuit or the like at the electrical part of the energy generating part 32D (especially the individual piezoelectric element 34). Whereas, the pinholes on the vibrating plate 23 is not a problem functionally. Accordingly, if ink oozing can be prevented, there is no problem occurring as an ink jet recording head in driving. Accordingly, ink oozing can be protected while serving the low power consumption without deteriorating the drive (deformation, displacement) of the energy generating part 32D.

In the following, a production method of an ink jet recording head that is a sixth embodiment example of the present invention is described, using FIG. 12. In the description of the present embodiment example, the same steps as the production methods for the ink jet recording head relative to the fourth and the fifth embodiment examples described above will be omitted. This will apply to each of embodiment examples described hereunder.

In the present embodiment example also, first the electrode layer 21 is formed on the base plate 20 of MgO by the spattering method, and alignment marks and a plurality of individual electrodes are formed by photo-etching (FIG. 12(A),(B)). Subsequently, on the electrode layer 21 on which the individual electrodes 26 are provided, the individual piezoelectric elements 34 and the frame 35 are formed by spattering a piezoelectric material to make an about 3 $\mu$m thick layer and etching afterwards (FIG. 12(C)).

In the fifth embodiment example described above, the structure was that the filling material 36 was provided after the individual piezoelectric elements 34 and the frame 35 had been formed. In the present embodiment example, it is featured that a vibrating plate 37 is formed directly on the individual electrodes 26 and the frame 35, without providing the filling material 36 after the individual piezoelectric elements 34 and the frame 35 are formed (FIG. 12(D)).

In this manner, by forming the vibrating plate 37 without providing the filling material 36, the structure is such that the vibrating plate 37 follows the unevenness of the individual piezoelectric element 34, as if possessing a cross-sectional shape of a corrugated plate. Subsequent steps (FIG. 12(E) through (H)) are similar to the fifth embodiment example, and description is omitted.

The ink jet recording head produced by the present embodiment example has a structure that a vibrating plate 37 intervenes between adjacent energy generating parts 32E. Accordingly, drive at each of the energy generating part 32E is poorer than the ink jet recording head produced by the fifth embodiment example described above. However, it can realize a better drive comparing with the ink jet recording heads 40C and 40D wherein the structure is of a contiguous piezoelectric element 27 as shown in FIG. 7 and FIG. 9.

Figure 13:
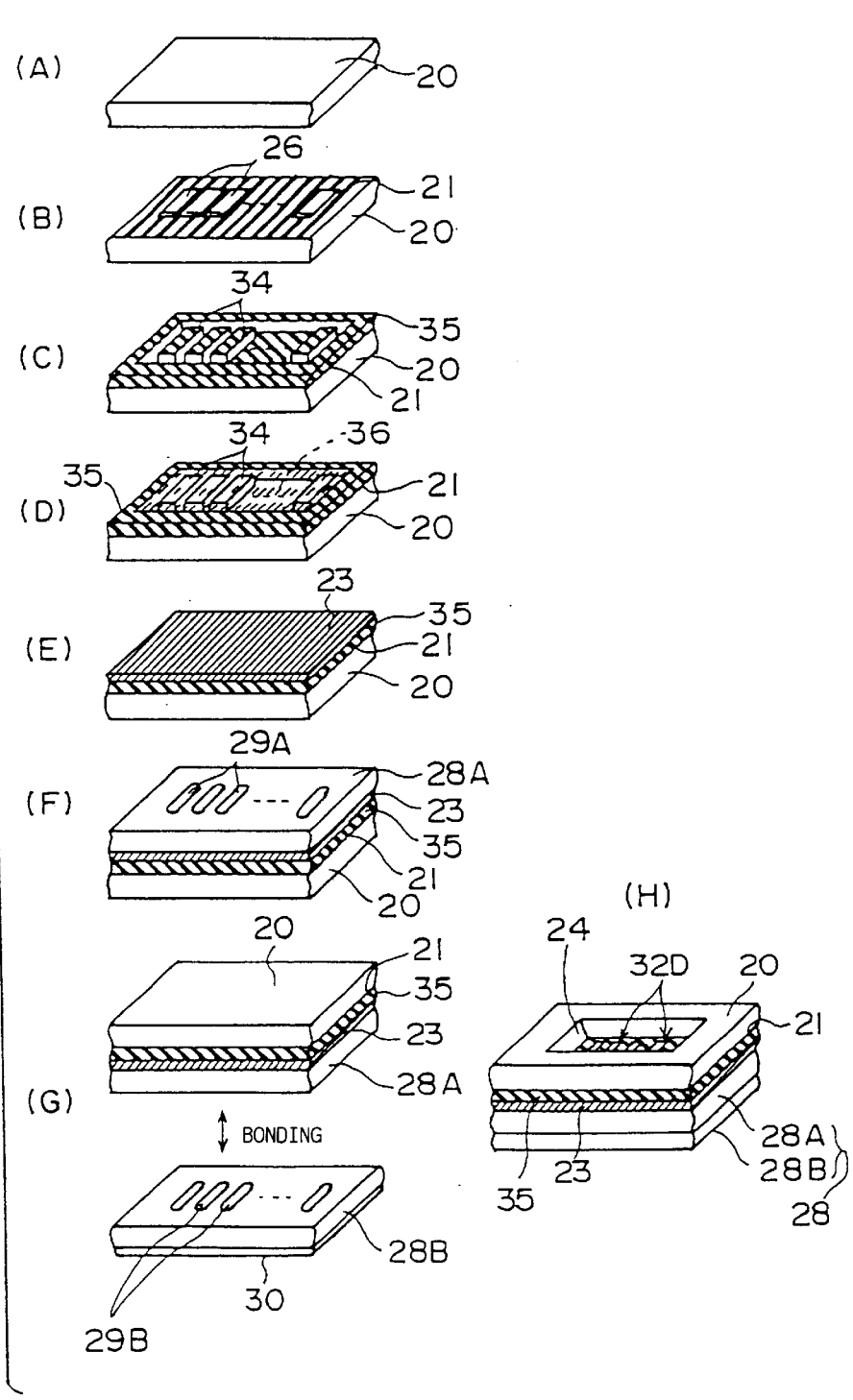
FIG. 13 is a drawing to explain a production method of the ink jet recording head of the seventh embodiment example.
Figure 14:
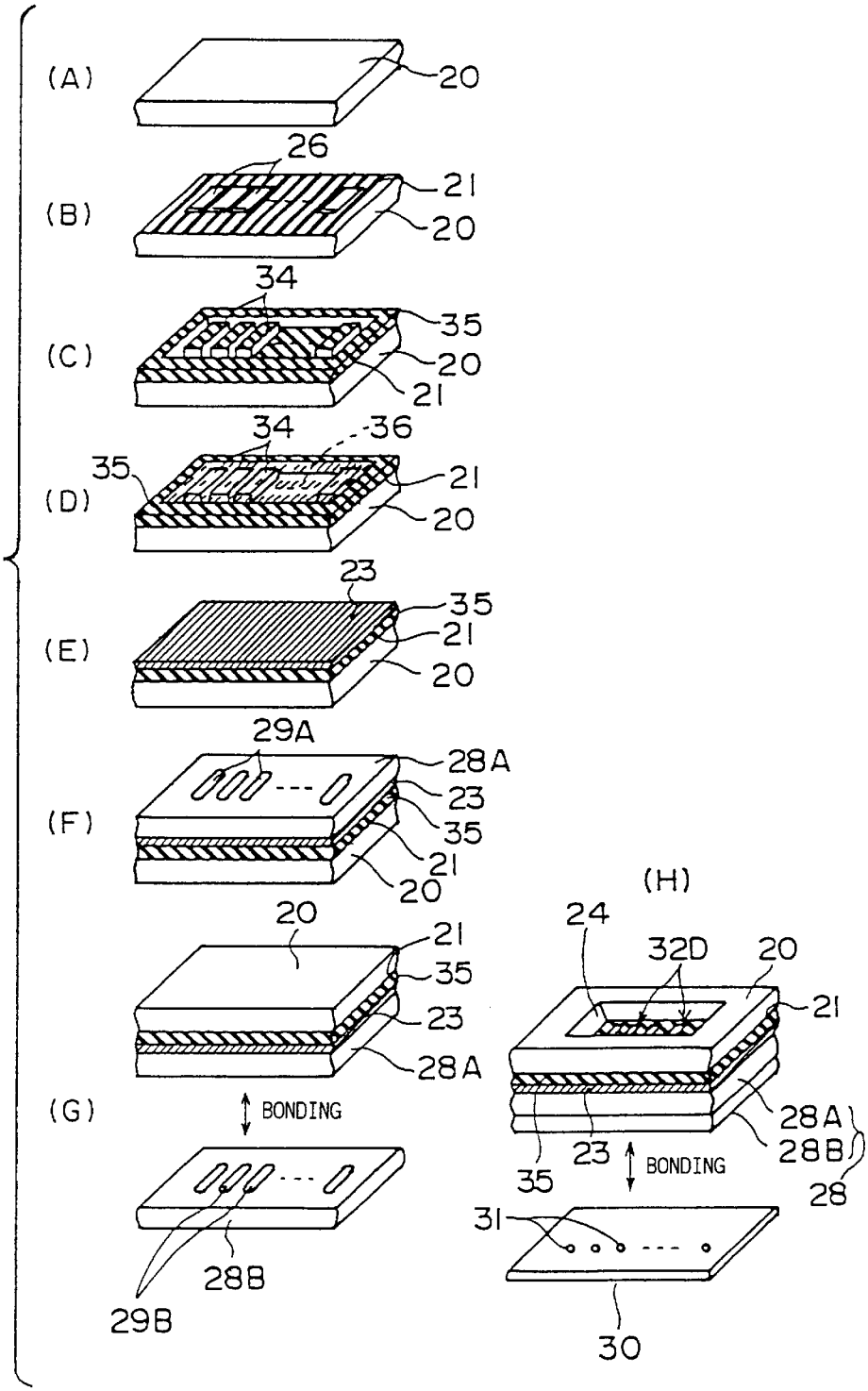
FIG. 14 is a drawing to explain a production method of the ink jet recording head of the eighth embodiment example.

In the following production method of an ink jet recording head of a seventh and an eighth embodiment examples of the present invention using FIG. 13 and FIG. 14.

In the seventh and the eighth embodiment examples, the steps shown in FIG. 13(A) through (F) and FIG. 14(A) through (F) are identical to the steps of FIG. 11(A) through (F) for the fifth embodiment example described above, therefore, a description is omitted.

In each of the embodiment examples described above (e.g. the fifth embodiment example), the structure was that the second main body half 28B was provided after the opening part 24 was formed on the base plate 20 by performing the removal step. In contrast, the present embodiment examples are featured by performing the removal step to form the opening part 24 after forming the main body 28 by bonding the first main body half 28A and the second main body half 28B by performing the bonding step.

In this manner, by performing the removal step after the bonding step, the rear side of the base plate 20 is bonded with the main body 28 (the first and the second main body halves 28A and 28B) when the opening part 24 is formed in the removal step. In this manner, the energy generating parts 32D formed on the base plate 20 are protected from damages when the opening part 24 is formed, thereby enhancing the yields and the reliability.

Further in the seventh embodiment example, the structure is such that the nozzle plate 30 is formed in advance to the second main body half 28B which is then bonded with the first pressure chamber half 28A (refer to FIG. 13(G)). Further, in the eighth embodiment example, the nozzle plate 30 is provided at the second main body half 28B after the second main body half 28B is bonded to the first pressure chamber half 28A (refer to FIGS. 14(G), H(H)).

As described above, the installation step wherein the nozzle plate 30 is provided to the main body 28 may be performed either before or after the bonding step wherein the fist and the second main body halves 28A and 28B.

Figure 15:
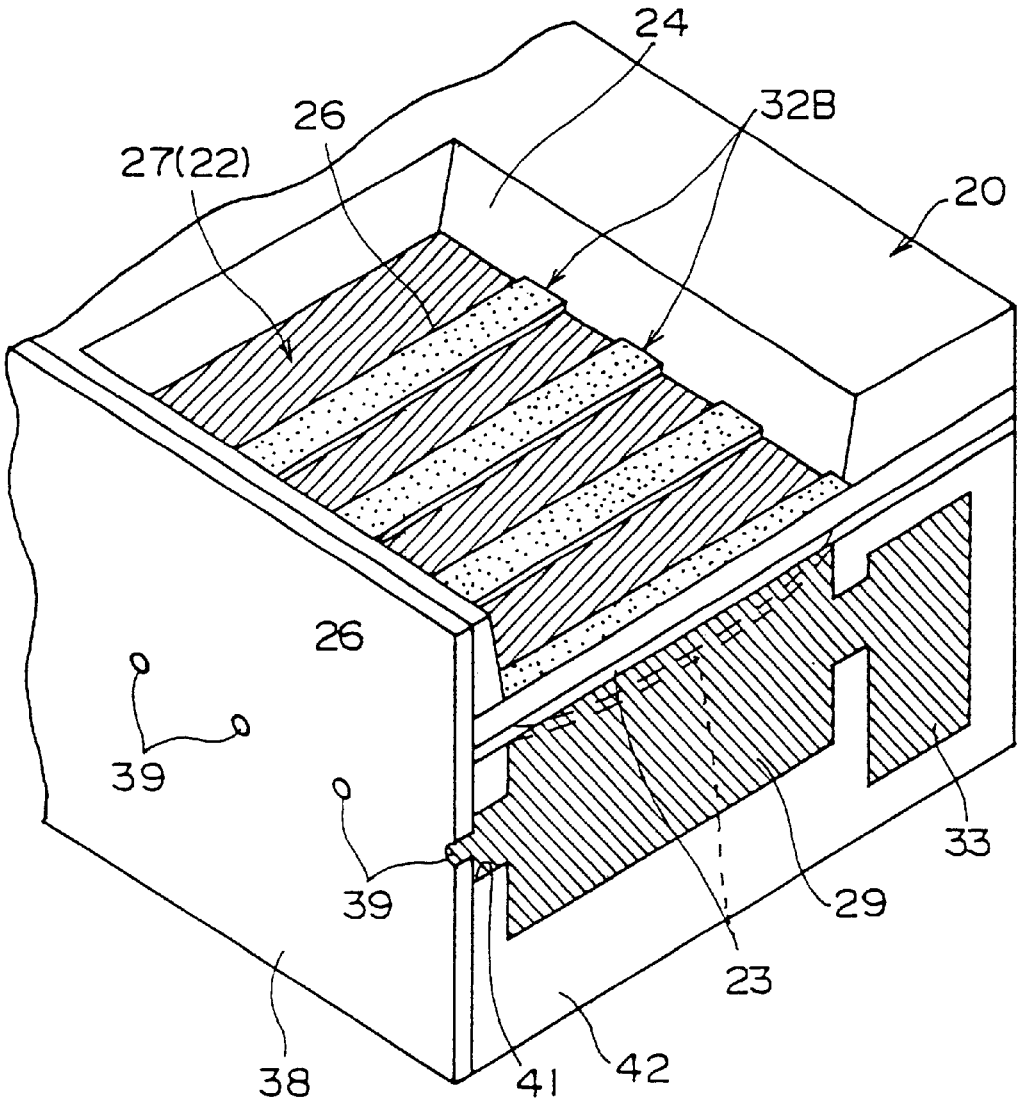
FIG. 15 is an oblique angle and cross-sectional drawing of the ink jet recording head of the fifth embodiment example of the present invention.

FIG. 15 shows an ink jet recording head 40E that is a fifth embodiment example of the present invention. In FIG. 15, as for the same structure as the ink jet recording head 40B relative to the second embodiment example described above using FIG. 5, the same number will be attached and its description will be omitted.

The ink jet recording head 40B relative to the second embodiment example described above was such that the main body 28 was formed by layers of dry film. The ink jet recording head 40E relative to the present embodiment example is not such that a main body 42 is a pressure chamber layered onto a nozzle plate 38 but that the main body 42 is formed by layering dry film to a plate material such as a silicon base plate.

And, the dry film is bonded and hardened to the plate material under the similar conditions to those as described in the second embodiment example, and then an edge that is to become the bonding face to the nozzle plate 38 is cut by a dicing saw. In the present embodiment example, it was cut at a 0.1 mm distance from the upper face edge of the opening part 24 of the base plate 20. Further, an ink jet hole 41 which connects the pressure chamber 29 and the nozzle 39 is structured such that it has already been formed when the dry film is formed.

And further, by aligning and bonding the nozzle plate 38 to the cutting surface, the ink jet recording head 40E shown in FIG. 15 was formed. Despite that the ink jet recording head 40E as in this embodiment example is of a side-shoot type, it can produce a low power consumption and high yield head.

Further, the present invention is not limited to these embodiments specifically disclosed, but various variations and modifications may be made without departing from the scope of the present invention as claimed.

What is claimed is:

1. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers that spout ink is bonded to said vibrating layer; and a nozzle plate installation step wherein a nozzle plate is provided to said main body while forming a nozzle hole which spouts ink at a position corresponding to said pressure chambers.

2. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, wherein said bonding step comprising:

a first bonding step, to be performed between said energy generating part forming step and said removal step, wherein a first main body half preformed with a first pressure chamber half for spouting ink is bonded onto said vibrating layer; and a second bonding step wherein a second main body half pre-formed with a second pressure chamber half for spouting ink is bonded to said first main body half after said removal step.

3. The ink jet recording head production method as claimed in claim 2, said energy generating part forming step comprises a dividing step wherein the individual electrodes are formed by dividing said individual electrode layer at the forming position of said ink jet energy generating part after said individual electrode layer is formed and before said energy generating layer is formed.

4. The ink jet recording head production method as claimed in claim 2, wherein said energy generating part forming step comprises a dividing step wherein both said individual electrode layer exposed in said opening part and said energy generating layer are divided at the forming position of said ink jet energy generating part after said removal step is finished.

5. The ink jet recording head production method as claimed in claim 2 wherein said energy generating part forming step comprises a dividing step wherein the individual electrodes are formed by dividing only said individual electrode layer exposed in said opening part at the forming position of said ink jet energy generating part after said removal step is finished.

6. The ink jet recording head production method as claimed in claim 2, an ink jet recording head production method wherein said nozzle plate installation step is performed before said bonding step.

7. The ink jet recording head production method as claimed in claim 2, an ink jet recording head production method where in said nozzle plate installation step is performed after said bonding step.

8. The ink jet recording head production method as claimed in claim 2, further comprising a heat dissipation part forming step wherein a high heat conductivity material is provided to the opening part formed in said base plate after said removal step.

9. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, wherein said energy generating part forming step comprises a dividing step wherein individual electrodes are formed by dividing said individual electrode layer is divided as a forming position of said ink jet energy generating part after said individual electrode layer is formed and before said energy generating layer is formed.

10. The ink jet recording head production method which provides the dividing position to perform said dividing process in said dividing step at in between adjacent said pressure chambers in the ink jet recording head production method as claimed in claim 9.

11. The ink jet recording head production method as claimed in claim 9, an ink jet recording head production method wherein said nozzle plate installation step is performed before said bonding step.

12. The ink jet recording head production method as claimed in claim 9, an ink jet recording head production method where in said nozzle plate installation step is performed after said bonding step.

13. The ink jet recording head production method as claimed in claim 9, further comprising a heat dissipation part forming step wherein a high heat conductivity material is provided to the opening part formed in said base plate after said removal step.

14. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including pre-formed pressure chambers to spout ink is bonded to said vibrating layer; and a nozzle plate installation step wherein a nozzle plate is provided to said main body while forming a nozzle hole which spouts ink at a position corresponding to said pressure chambers, wherein said energy generating part forming step comprises a dividing step wherein the individual electrodes are formed by dividing both said individual electrode layer exposed in said opening part and said energy generating layer at the forming position of said ink jet energy generating part after said removal step.

15. The ink jet recording head production method which provides the dividing position to perform said dividing process in said dividing step at in between adjacent said pressure chambers in the ink jet recording head production method as claimed in claim 14.

16. The ink jet recording head production method as claimed in claim 14, an ink jet recording head production method wherein said nozzle plate installation step is performed before said bonding step.

17. The ink jet recording head production method as claimed in claim 14, an ink jet recording head production method where in said nozzle plate installation step is performed after said bonding step.

18. The ink jet recording head production method as claimed in claim 14, further comprising a heat dissipation part forming step wherein a high heat conductivity material is provided to the opening part formed in said base plate after said removal step.

19. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including pre-formed pressure chambers to spout ink is bonded to said vibrating layer; and a nozzle plate installation step wherein a nozzle plate is provided to said main body while forming a nozzle hole which spouts ink at a position corresponding to said pressure chambers, wherein said energy generating part forming step comprises a dividing step wherein the individual electrodes are formed by dividing only said individual electrode layer exposed in said opening part at the forming position of said ink jet energy generating part after said removal step is finished.

20. The ink jet recording head which form said ink jet energy generating part over a plurality of said pressure chambers in said energy generating part forming step in the production method of the ink jet recording head described in claim 19.

21. The ink jet recording head production method which provides the dividing position to perform said dividing process in said dividing step at in between adjacent said pressure chambers in the ink jet recording head production method as claimed in claim 19.

22. The ink jet recording head production method as claimed in claim 19, an ink jet recording head production method wherein said nozzle plate installation step is performed before said bonding step.

23. The ink jet recording head production method as claimed in claim 8, an ink jet recording head production method where in said nozzle plate installation step is performed after said bonding step.

24. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

an individual electrode forming step wherein the individual electrodes are formed in the corresponding position of said ink jet energy generating part via said opening part, after said removal step is finished; and a bonding step wherein the main body including pre-formed pressure chambers to spout ink is bonded to said vibrating layer.

25. The ink jet recording head production method as claimed in claim 24, an ink jet recording head production method wherein said nozzle plate installation step is performed before said bonding step.

26. The ink jet recording head production method comprising:

an individual electrode forming step wherein an individual electrode layer is formed on the base plate using the thin film forming technology;

an individual energy generating layer forming step wherein an individual energy generating layer is formed at least on said individual electrode layer;

a filling step wherein a filing material is provided in gaps between said individual energy generating layers formed in said individual energy generating layer forming step;

an energy generating part forming step wherein the ink jet energy generating part is formed by performing a vibrating layer forming step wherein a vibrating layer is formed on said energy generating layer and said filling material after said filling step is finished;

a removal step wherein said ink jet energy generating part is exposed from said base plate by forming an opening part by removing at least an part corresponding to deforming portion of said ink jet energy generating part of said base plate; and a bonding step wherein a main body pre-formed with pressure chambers to spout ink and said vibrating plate are bonded.

27. The ink jet recording head production method as claimed in claim 26, an ink jet recording head production method wherein said nozzle plate installation step is performed before said bonding step.

28. The ink jet recording head production method as claimed in claim 26, an ink jet recording head production method where in said nozzle plate installation step is performed after said bonding step.

29. The ink jet recording head production method as claimed in claim 26, further comprising a heat dissipation part forming step wherein a high heat conductivity material is provided to the opening part formed in said base plate after said removal step.

30. The ink jet recording head production method comprising:

an individual electrode forming step wherein an individual electrode layer is formed on the base plate using the thin film forming technology;

an individual energy generating layer forming step wherein an individual energy generating layer is formed at least on said individual electrode layer;

a filling step wherein a filing material is provided in gaps between said individual energy generating layers formed in said individual energy generating layer forming step;

an energy generating part forming step wherein the ink jet energy generating part is formed by performing a vibrating layer forming step wherein a vibrating layer is formed on said energy generating layer and said filling material after said filling step is finished;

a removal step wherein said ink jet energy generating part is exposed from said base plate by forming an opening part by removing at least an part corresponding to deforming portion of said ink jet energy generating part of said base plate; and a bonding step wherein a main body pre-formed with pressure chambers to spout ink and said vibrating plate are bonded, wherein the filling material uses the same material as said base plate.

31. The ink jet recording head production method as claimed in claim 30 wherein said filling material uses a material that has elastic and anti-ink properties.

32. The ink let recording head production method as claimed in claim 30, an ink jet recording head production method wherein said nozzle plate installation step is performed before said bonding step.

33. The ink jet recording head production method as claimed in claim 30, an ink jet recording head production method where in said nozzle plate installation step is performed after said bonding step.

34. The ink jet recording head production method as claimed in claim 30, further comprising a heat dissipation part forming step wherein a high heat conductivity material is provided to the opening part formed in said base plate after said removal step.

35. The ink jet recording head production method comprising:

an individual electrode forming step wherein an individual electrode layer is formed on the base plate using the thin film forming technology;

an individual energy generating layer forming step wherein an individual energy generating layer is formed at least on said individual electrode layer;

a filling step wherein a filling material is provided in gaps between said individual energy generating layers formed in said individual energy generating layer forming step;

an energy generating part forming step wherein the ink jet energy generating part is formed by performing a vibrating layer forming step wherein a vibrating layer is formed on said energy generating layer and said filling material after said filling step is finished;

a removal step wherein said ink jet energy generating part is exposed from said base plate by forming an opening part by removing at least an part corresponding to deforming portion of said ink jet energy generating part of said base plate; and a bonding step wherein a main body pre-formed with pressure chambers to spout ink and said vibrating plate are bonded, wherein said filling material uses a material whose Young's modulus is smaller than the material of said energy generating layer, less than 90 GPa.

36. The ink jet recording head production method as claimed in claim 35 wherein said filling material uses a material that has elastic and anti-ink properties.

37. The ink jet recording head production method as claimed in claim 35, an ink jet recording head production method wherein said nozzle plate installation step is performed before said bonding step.

38. The ink jet recording head production method as claimed in claim 35, an ink jet recording head production method where in said nozzle plate installation step is performed after said bonding step.

39. The ink jet recording head production method as claimed in claim 35, further comprising a heat dissipation part forming step wherein a high heat conductivity material is provided to the opening part formed in said base plate after said removal step.

40. The ink jet recording head production method comprising:

an individual electrode forming step wherein an individual electrode layer is formed on the base plate using the thin film forming technology;

an individual energy generating layer forming step wherein an individual energy generating layer is formed at least on said individual electrode layer;

a filling step wherein a filling material is provided in gaps between said individual energy generating layers formed in said individual energy generating layer forming step;

an energy generating part forming step wherein the ink jet energy generating part is formed by performing a vibrating layer forming step wherein a vibrating layer is formed on said energy generating layer and said filling material after said filling step is finished;

a removal step wherein said ink jet energy generating part is exposed from said base plate by forming an opening part by removing at least an part corresponding to deforming portion of said ink jet energy generating part of said base plate; and a bonding step wherein a main body pre-formed with pressure chambers to spout ink and said vibrating plate are bonded, wherein said filling material uses a material that has elastic and anti-ink properties.

41. The ink jet recording head production method as claimed in claim 40, an ink jet recording head production method wherein said nozzle plate installation step is performed before said bonding step.

42. The ink jet recording head production method as claimed in claim 40, an ink jet recording head production method where in said nozzle plate installation step is performed after said bonding step.

43. The ink jet recording head production method as claimed in claim 40, further comprising a heat dissipation part forming step wherein a high heat conductivity material is provided to the opening part formed in said base plate after said removal step.

44. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, wherein said removal step is performed after said bonding step is finished.

45. The ink jet recording head production method as claimed in claim 44, an ink jet recording head production method wherein said nozzle plate installation step is performed before said bonding step.

46. The ink jet recording head production method as claimed in claim 44, an ink jet recording head production method where in said nozzle plate installation step is performed after said bonding step.

47. In the ink jet recording head production method as claimed in claim 44, further comprising a heat dissipation part forming step wherein a high heat conductivity material is provided to the opening part formed in said base plate after said removal step.

48. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, wherein said nozzle plate installation step is performed before said bonding step.

49. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, wherein said nozzle plate installation step is performed after said bonding step.

50. An ink jet recording head production method comprising:

an energy generating part forming step wherein the ink jet energy generating part is formed by sequentially forming an individual electrode layer, an energy generating layer and a vibrating layer on a base plate using the thin film forming technology;

a removal step wherein said ink jet energy generating part is exposed from said base plate by forming an opening part by removing an part corresponding to at least a deforming portion of said ink jet energy generating part of said base plate;

a bonding step wherein the main body including preformed pressure chambers to spout ink is bonded to said vibrating layer; and a nozzle plate installation step wherein a nozzle plate is provided to said main body while forming a nozzle hole which spouts ink at a position corresponding to said pressure chambers, further comprising a heat dissipation part forming step wherein a high heat conductivity material is provided to the opening part formed in said base plate after said removal step.

51. An ink jet recording head that comprises a pressure chamber and a piezoelectric element and that spouts ink from said pressure chamber by deforming said piezoelectric element by electrical signals, an ink jet recording head that uses a piezoelectric element formed by a growth step wherein said piezoelectric element is grown on a base plate using the thin film forming technology and a removal step wherein a portion of the base plate corresponding to deforming portion of said piezoelectric element is removed while leaving the base plate at the peripheral of the deforming part of said piezoelectric element.

52. A printer apparatus that is provided with an ink jet recording head that comprises a pressure chamber and a piezoelectric element and that spouts ink from said pressure chamber by deforming said piezoelectric element by electrical signals, a printer apparatus that uses a piezoelectric element formed by the growth step wherein said piezoelectric element is grown on a base plate using the thin film forming technology and the removal step wherein a portion of the base plate corresponding to deforming portion of said piezoelectric element is removed while leaving the base plate at the peripheral of the deforming part of said piezoelectric element.

* * * * *

UNITED STATES PATENT AND TRADEMARK OFFICE

CERTIFICATE OF CORRECTION

PATENT NO. : 6,623,110 B2
DATED : September 23, 2003
INVENTOR(S) : Koike, Shuji et al.

It is certified that error appears in the above-identified patent and that said Letters Patent is hereby corrected as shown below:

Title page,
Item [73], change "73 Assignee: Fujitsu, Limited, Kawasaki (JP)" to be
-- [73] Assignee: Fujitsu Limited, Kawasaki (JP)" --

Signed and Sealed this

First Day of June, 2004

JON W. DUDAS
*Acting Director of the United States Patent and Trademark Office*